US012551037B2

(12) United States Patent
Pesale

(10) Patent No.: US 12,551,037 B2
(45) Date of Patent: Feb. 17, 2026

(54) PILLOW SYSTEM

(71) Applicant: Catherine M. Pesale, Milford, CT (US)

(72) Inventor: Catherine M. Pesale, Milford, CT (US)

( * ) Notice: Subject to any disclaimer, the term of this patent is extended or adjusted under 35 U.S.C. 154(b) by 229 days.

(21) Appl. No.: 18/308,396

(22) Filed: Apr. 27, 2023

(65) Prior Publication Data

US 2023/0380608 A1 Nov. 30, 2023

Related U.S. Application Data

(60) Provisional application No. 63/335,448, filed on Apr. 27, 2022.

(51) Int. Cl.
*A47G 9/10* (2006.01)

(52) U.S. Cl.
CPC ..... *A47G 9/10* (2013.01)

(58) Field of Classification Search
CPC ..... A47G 9/10; A47G 2009/1018; A47G 9/1045; A47G 9/0253; A47C 7/383
USPC ..... 5/636, 640
See application file for complete search history.

(56) References Cited

U.S. PATENT DOCUMENTS 4,335,165 A * 6/1982 Powers ..... A47G 33/08 D11/131
4,850,927 A * 7/1989 Caranica ..... A63H 3/003 446/369
7,788,750 B2 * 9/2010 Norstrem ..... A47G 9/10 5/640
9,307,842 B2 * 4/2016 Gibbons ..... A47C 20/021
10,736,444 B1 * 8/2020 Leach ..... A47G 9/0253
10,918,217 B2 * 2/2021 Fuerstenberg ..... A47C 7/383
2006/0282952 A1 * 12/2006 Laxton ..... A47G 9/1009 5/636
2016/0345760 A1 * 12/2016 Pesale ..... A47G 9/109

OTHER PUBLICATIONS

"DIY puzzle piece pillow tutorial", YouTube, Sprout, Date: Dec. 20, 2016, "https://www.youtube.com/watch?v=6moAdy0ILEs" (Year: 2016).*
"The Original Pillowcase with a Hole", Amazon, The Pillow With A Hole Ltd, Date: Jun. 9, 2018, "https://www.amazon.com/ Original-P-W-H-Pillowcase-Hole/dp/B073XM7WHJ" (Year: 2018).*

* cited by examiner

*Primary Examiner* — David R Hare
*Assistant Examiner* — George Samuel Gines
(74) *Attorney, Agent, or Firm* — Ware, Fressola, Maguire & Barber LLP

(57) ABSTRACT

An interlocking pillow system is provided that may include two separable pillow forms configured to removably interlock together to form a pillow system. The interlocking pillow system may further include a supplementary pillow configured for removable attachment to the pillow system configured for use for back, head, neck and/or body support. The interlocking pillow system may include a square, rectangular or circular shaped pillow form with a passageway formed there through. The interlocking pillow system may also include another square, rectangular or circular shaped pillow form having a pair of notches formed in opposite sides of the pillow form. The interlocking pillow system is configured such that at least a portion of the pillow form having the pair of notches is configured to be passed through the passageway so as to retain the pillow forms together as to create the pillow system.

18 Claims, 21 Drawing Sheets

PILLOW SYSTEM

CROSS REFERENCE TO RELATED APPLICATIONS

This application claims priority to U.S. Provisional Appl. No. 63/335,448 filed Apr. 27, 2022, which is hereby incorporated by reference in its entirety.

BACKGROUND OF THE INVENTION

1. Field of the Invention

The present invention generally relates to a pillow system, and more particularly to an interlocking pillow system comprised of one or more interlocking pillow forms configured to provide support and cushioning to a user.

SUMMARY OF THE INVENTION

In accordance with exemplary aspects of the present invention, an interlocking pillow system is provided that may include two separable pillow forms configured to removably interlock together to form a supportive and comfortable pillow, for example a back pillow.

In accordance with the exemplary aspects of the present invention, the pillow system may include a first pillow form having a passageway formed therein, and a second pillow form having a first notch formed in a first side of the pillow form, and a second notch formed in a second side of the pillow form, where the first side may be opposite from the second side.

In accordance with the exemplary aspects of the present invention, the first notch and the second notch of the second pillow form may be positioned on an axis of the second pillow form.

In accordance with the exemplary aspects of the present invention, the first pillow form and the second pillow form may be configured for an interlocking relationship in which at least a section of the passageway is positioned along the axis of the second pillow form.

In accordance with the exemplary aspects of the present invention, the axis may be a boundary between a first portion of the second pillow form and a second portion of the second pillow form.

In accordance with the exemplary aspects of the present invention, in the interlocking relationship of the first pillow form and the second pillow form, the first portion of the second pillow form and the second portion of the second pillow form may be positioned on opposite sides of the passageway of the first pillow form.

In accordance with the exemplary aspects of the present invention, the first pillow form may include a perimeter, and a first side of the passageway may be positioned at a first distance from the perimeter and a second side of the passageway may be positioned at a second distance from the perimeter.

In accordance with the exemplary aspects of the present invention, at least part of the first portion, the second portion or both may be positioned within the passageway in the interlocking relationship of the first pillow form and the second pillow form.

In accordance with the exemplary aspects of the present invention, the first portion of the second pillow form positioned on one side of the passageway in the interlocking relationship may be substantially equal in size to the second portion of the second pillow form positioned on an opposite side of the passageway in the interlocking relationship.

In accordance with the exemplary aspects of the present invention, the first distance and the second distance may be substantially equal.

In accordance with the exemplary aspects of the present invention, the first pillow form and the second pillow form may be substantially rectangular in shape.

In accordance with the exemplary aspects of the present invention, the first pillow form and the second pillow form may be substantially circular in shape.

In accordance with the exemplary aspects of the present invention, the pillow system may also include a first pillow form case having a hole formed therein and configured to at least partially encase the first pillow form, and a second pillow form case having a pair of indents formed therein and configured to at least partially encase the second pillow form.

In accordance with the exemplary aspects of the present invention, the first pillow form and the second pillow form may each include a fill material.

In accordance with the exemplary aspects of the present invention, the pillow system may also include a supplementary pillow form having an arched surface, a concave surface positioned opposite the arched surface and a plurality of angled sides connecting the arched surface with the concave surface.

In accordance with the exemplary aspects of the present invention, the supplementary pillow form may include a supplementary pillow cover configured to at least partially encase the supplementary pillow form and having a strap configured to removably affix the supplementary pillow form to at least one of the first pillow form or the second pillow form.

In accordance with the exemplary aspects of the present invention, the arched top of the supplementary pillow form may be quilted.

In accordance with the exemplary aspects of the present invention, the plurality of angled sides may include a first pair of angled sides positioned opposite each other and in a non-parallel orientation, and a second pair of angled sides positioned opposite each other and in a non-parallel orientation, where the first pair of angled sides are larger than the second pair of angled sides.

In accordance with the exemplary aspects of the present invention, the supplementary pillow form may include a fill material.

In accordance with the exemplary aspects of the present invention, a pillow system may include at least two supplementary pillow forms, and a casing at least partially containing the supplementary pillow forms.

In accordance with the exemplary aspects of the present invention, each supplementary pillow form may include an arched surface, a concave surface positioned opposite the arched surface and a plurality of angled sides connecting the arched surface with the concave surface.

In accordance with the exemplary aspects of the present invention, the plurality of angled sides of each supplementary pillow form may include a first pair of angled sides positioned opposite each other and in a non-parallel orientation, and a second pair of angled sides positioned opposite each other and in a non-parallel orientation, where the first pair of angled sides are larger than the second pair of angled sides.

In accordance with the exemplary aspects of the present invention, each supplementary pillow form may include a fill material.

In accordance with the exemplary aspects of the present invention, the pillow system may include an additional supplementary pillow form.

In accordance with the exemplary aspects of the present invention, each of the supplementary pillow forms may be arranged in the casing such that one of the sides of the second pair of angled side of each supplementary pillow form are in contact with each other.

According to the exemplary aspects of the present invention, the interlocking pillow system may further include a head pillow configured for removable attachment, for example, through use of snaps, to the supportive and comfortable back pillow resulting in a multifunctional and supportive pillow system configured for use for back, head, neck and/or body support.

According to the exemplary aspects of the present invention, the interlocking pillow system may include a square, rectangular or circular shaped pillow form with a passageway formed there through. The pillow form may be constructed from a top fabric and a bottom fabric stitched together with the passageway cutout and stitched together. The passageway may be, for example, in the form of a rectangular opening or longitudinal slit. The pillow form may be filled with a poly fiber fill, shredded foam, other suitable material or combination thereof that would support a user of the pillow form. The fabric may be a cotton or cotton blend material, but it is understood the present invention is not limited to any particular fabric and/or fabric combination. For example, the fabric may be designer, upholstery or quilted knit fabrics.

According to the exemplary aspects of the present invention, the interlocking pillow system may include a loop on the top of the pillow form, and the loop may be configured for attachment to the head pillow.

According to the exemplary aspects of the present invention, the interlocking pillow system may also include another square, rectangular or circular shaped pillow form having a pair of notches formed in opposite sides of the pillow form. This pillow form may be constructed from a top fabric and a bottom fabric stitched together with the notches cutout and stitched together. This pillow form may be filled with a poly fiber fill, shredded foam, other suitable material or combination thereof that would support the user of the pillow form. The fabric may be a cotton or cotton blend material, but it is understood the present invention is not limited to any particular fabric and/or fabric combination. For example, the fabric may be designer, upholstery or quilted knit fabrics.

According to the exemplary aspects of the present invention, the interlocking pillow system is configured to allow interlocking of the pillow form and other pillow form by inserting at least a portion of the other pillow form into the passageway of the pillow form, and pulling one side of the other pillow form through the passageway. This results in an interlocked shape that allows the user to lean back and be supported from either side of the pillow system. The center part of the pillow system forms an indentation that allows the user's spine to be supported without any hard or harsh materials directly on the spinal column. The pillow forms of the interlocking pillow system work together in a way that the weight of the body compresses the pillow forms as much as needed and actually hugs the back without being too bulky, and then goes back to its original shape when not in use.

According to the exemplary aspects of the present invention, the interlocking pillow system may include a head and neck support attached to the interlocked pillow forms. The head and neck support may be attached with a tab and snap configured to be fed through the loop on the pillow form. The head support pillow form may have four sides, a larger top than bottom and may have a softer, more durable top fabric than the sides and bottom. The head support pillow attachment may have an arch design and uses a conoid or funnel shape where the top is much larger than the bottom and the arch or curve of the design results in the ability for compression from the weight of the user's head for comfort, and then rebounds back to recovery to its original shape. The head and neck support may be filled with a poly fill fiber, shredded foam or any other suitable material that would be comfortable to the user. The sides, top and bottom of the support may be made from a cotton or cotton blend material, but it is understood the present invention is not limited to any particular type of material. For example, the head and neck support may be made from design, upholstery or quilted knit fabrics. The head and neck support may be configured for use by snapping onto the interlocking back pillows through a tab on the back pillow and a tab on the head pillow with a snap closure. The head attachment may be used in chairs and couches where the user will be lounging or laying back to relax and sleep, read and/or watch television.

According to the exemplary aspects of the present invention, the interlocking pillow system may also be configured for use with office chairs, couches, reclining chairs and for support in a car. The interlocking pillow forms can be made out of durable fabrics to go with any variety of interior designs of a living and/or work space, for example, travel fabrics, premium cotton sheeting to go into a pillow case to compliment home décor.

According to the exemplary aspects of the present invention, the interlocking pillow system may include a pillow case having a zipper and an adjustable strap to secure the interlocking pillow system to a seat, for example a headrest in a car, in order to hold the interlocking pillow system at a certain place relative to the user for the user's comfort.

According to the exemplary aspects of the present invention, the interlocking pillow system may also be configured for use as a pet bed. The interlocking pillow system can be made at any size and can be sized for use with a variety of pets of a variety of sizes, such as cats and dogs.

According to the exemplary aspects of the present invention, a body pillow may be provided by combining more than one head and neck support pillows within a pillowcase, the pillowcase may be a large rectangular knit pillow case. For example, two or three head and neck support pillows may be combined within a long rectangular knit fabric pillow case for use as a body pillow. The body pillow will have flexibility due to it being able to bend in at least one place due to the internal segments created by the separate head and neck support pillows. In use, the user may be able to place one head and neck support pillow between the knees, have the middle head and neck support pillow hugged into the belly area and the third head and neck support pillow for the hands to hold and rest.

According to the exemplary aspects of the present invention, the body pillow may be formed into a U-shape and placed behind the back of a user for support while sitting in bed reading or while working at a computer.

According to the exemplary aspects of the present invention, the body pillow may also be configured to curve around the user in front of the user's body to allow for arm support on both sides while having the middle head and neck support pillow within the body pillow available for supporting a book, laptop or the like.

According to the exemplary aspects of the present invention, the body pillow may be configured for use in nursing a baby, as a result of the support given to the mother by resting her arms on both sides of the body pillow and having the middle head and neck support pillow support the weight of the baby.

BRIEF DESCRIPTION OF THE SEVERAL VIEWS OF THE DRAWINGS

For a fuller understanding of the nature and object of the present invention, reference should be had to the following detailed description taken in connection with the accompanying drawings, in which.

DETAILED DESCRIPTION OF THE INVENTION

Figure 1:
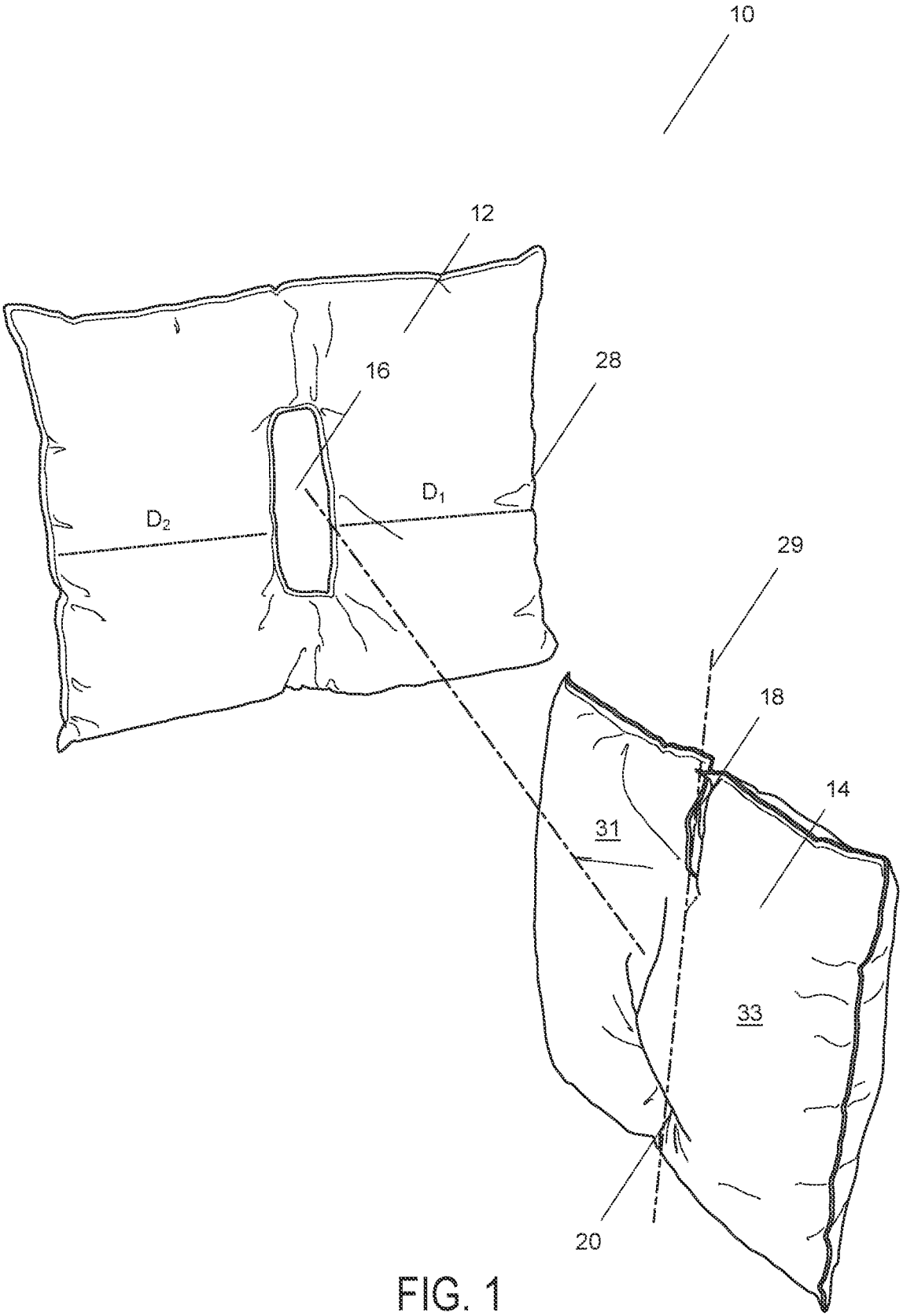
FIG. 1 is an exploded isometric view of an exemplary interlocking pillow system according to an exemplary aspect of the present invention.
Figure 2:
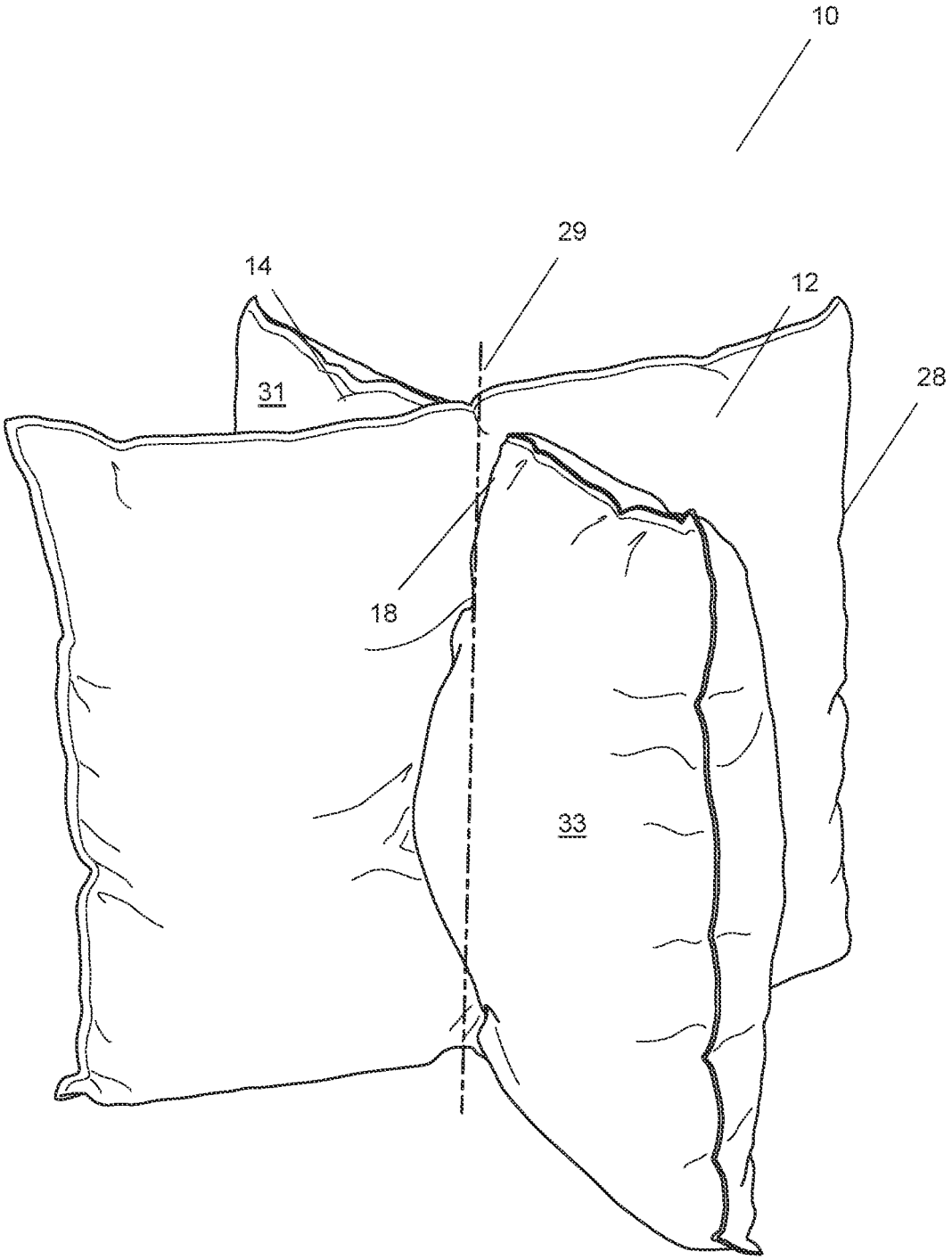
FIG. 2 is an isometric view of an exemplary interlocking pillow system according to an exemplary aspect of the present invention.

Aspects of the present invention now will be described more fully hereinafter with reference to the accompanying figures, in which exemplary embodiments of the invention are shown. The invention may, however, be embodied in many different forms and should not be construed as limited to the embodiments set forth herein. Like reference numerals refer to like elements throughout.

Referring now to FIGS. 1-5, therein illustrated is an exemplary embodiment of an interlocking pillow system, generally indicated by reference numeral 10, according to an exemplary aspect of the present invention. The interlocking pillow system 10 may include a first pillow form 12, and a second pillow form 14 configured for interlocking removable coupling with the first pillow form 12. The first pillow form 12 and the second pillow form 14 may be constructed of fabric coverings and filled with any suitable natural or synthetic pillow filling materials, such as poly fiber fill, shredded foam, down or any other material suitable to provide cushioning support to a user. For example, the first pillow form 12 and the second pillow form 14 may each be constructed by joining at least part of the perimeters of two pieces of fabric together through stitching, gluing and/or heat welding and then adding an appropriate amount of filling materials to the joined pieces of fabric and completely sealing and/or closing the pieces of fabric together so that the filling material cannot be easily removed from the constructed pillow form. It is understood that the construction of pillow forms is well known, and the present invention is not limited to any particular construction or fabrication of the pillow forms 12, 14.

Still referring to FIGS. 1-5, the first pillow form 12 may include a passageway 16, which may be formed in substantially the center area of the first pillow form 12. The first pillow form 12 may include a perimeter 28 extending around the first pillow form 12. The passageway 16 may be positioned a first distance $D_1$ from a side of the perimeter 28 and a second distance $D_2$ from another side of the perimeter 28. The first distance $D_1$ and the second distance $D_2$ may be substantially equal, such that the passageway 16 may be positioned substantially in the center of the first pillow form 12. It is understood that although the first distance $D_1$ and second distance $D_2$ are exemplary illustrated in the substantially the horizontal plane in FIG. 1, the distances between the passageway 16 and the sides of the perimeter 28 in the vertical plane may also be substantially equal. The passageway 16 may have a substantially rectangular, oval, or circular shape, and may be dimensioned so as to allow at least a portion of the second pillow form 14 to pass there through. It is understood that the present invention is not limited to any shape, size or configuration of the passageway 16, and any suitable opening formed in the first pillow form 12, for example a slit, is contemplated by the present invention.

Referring again to FIGS. 1-5, the second pillow form 14 may include a first notch 18 formed in one side of the second pillow form 14, and a second notch 20 formed in an opposing side of the second pillow form 14 as the first notch 18. The first notch 18 and the second notch 20 may be positioned on an axis 29 of the second pillow form 14. The first notch 18 and the second notch 20 may be formed as slits in the second pillow form 14, or as cutouts creating gaps in the periphery of the second pillow form 14. The first notch 18 and the second notch 20 may be positioned on the axis 29 of the second pillow form 14 such that the axis 29 forms a boundary between a first portion 31 of the second pillow form 14 and a second portion 33 of the second pillow form 14. It is understood the boundary formed by the axis 29 is not necessarily a physical boundary, but may rather simply be a demarcation between the first portion 31 and the second portion 33 of the second pillow form 14. The axis 29 may be positioned at substantially the mid-points of the sides of the second pillow form 14, such that when the second pillow form 14 is passed through the passageway 16 of the first pillow form 12, and the first notch 18 and the second notch 20 are engaged with the first pillow form 12, the sizes of the first portion 31 and the second portion 33 of the second pillow form 14 positioned on either side of the first pillow form 12 are substantially equal, as shown for example in FIGS. 4 and 5. In this interlocking relationship of the first pillow form 12 and the second pillow form 14 the interlocking pillow system 10 is composed, and at least a section of the passageway 16 of the first pillow form 12 is positioned along the axis 29 of the second pillow form 14. Furthermore, in the interlocking relationship at least part of the first portion 31, at least part of the second portion 33 or at least parts of each of the first portion 31 and second portion 33 are positioned within the passageway 16. The interlocked pillow system 10 is configured to allow the user to lean back and be supported from either side. The portion of the interlocked pillow system 10 where the first pillow form 12 and the second pillow form 14 intersect at or about the axis 29 of the second pillow form 14 forms an indentation that allows the user's spine to be supported without any hard or harsh materials directly on the spinal column. Furthermore, the interlocking pillow system 10 provides an interlocking arrangement of the first pillow form 12 and the second pillow form 14 such that the weight of the body of the user compresses the interlocking pillow system 10 as much as needed and hugs the back of the user without being too bulky, while going back to its original shape when not in use.

Figure 3:
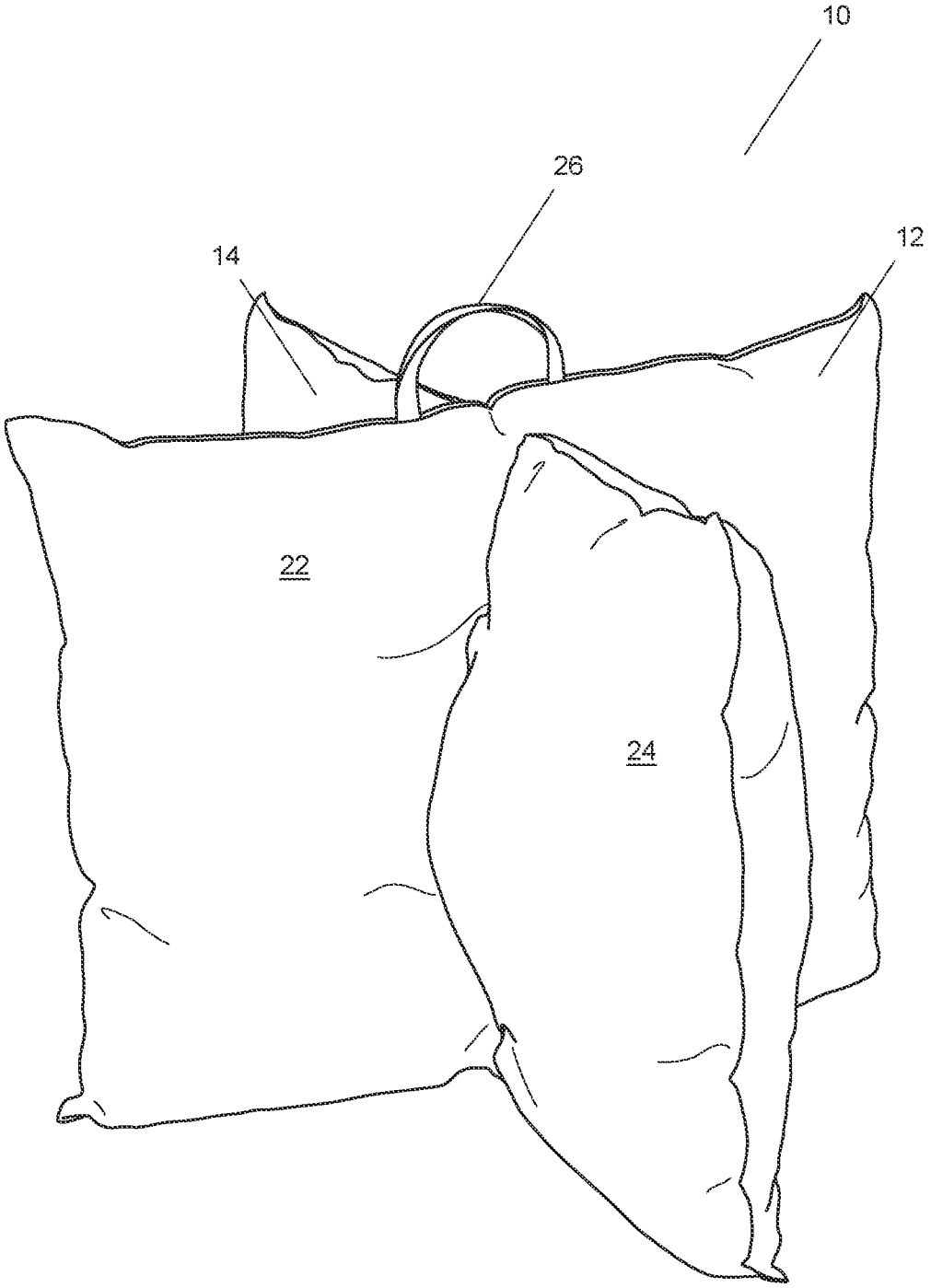
FIG. 3 is an isometric view of an exemplary interlocking pillow system according to an exemplary aspect of the present invention within an exemplary covering.
Figure 4:
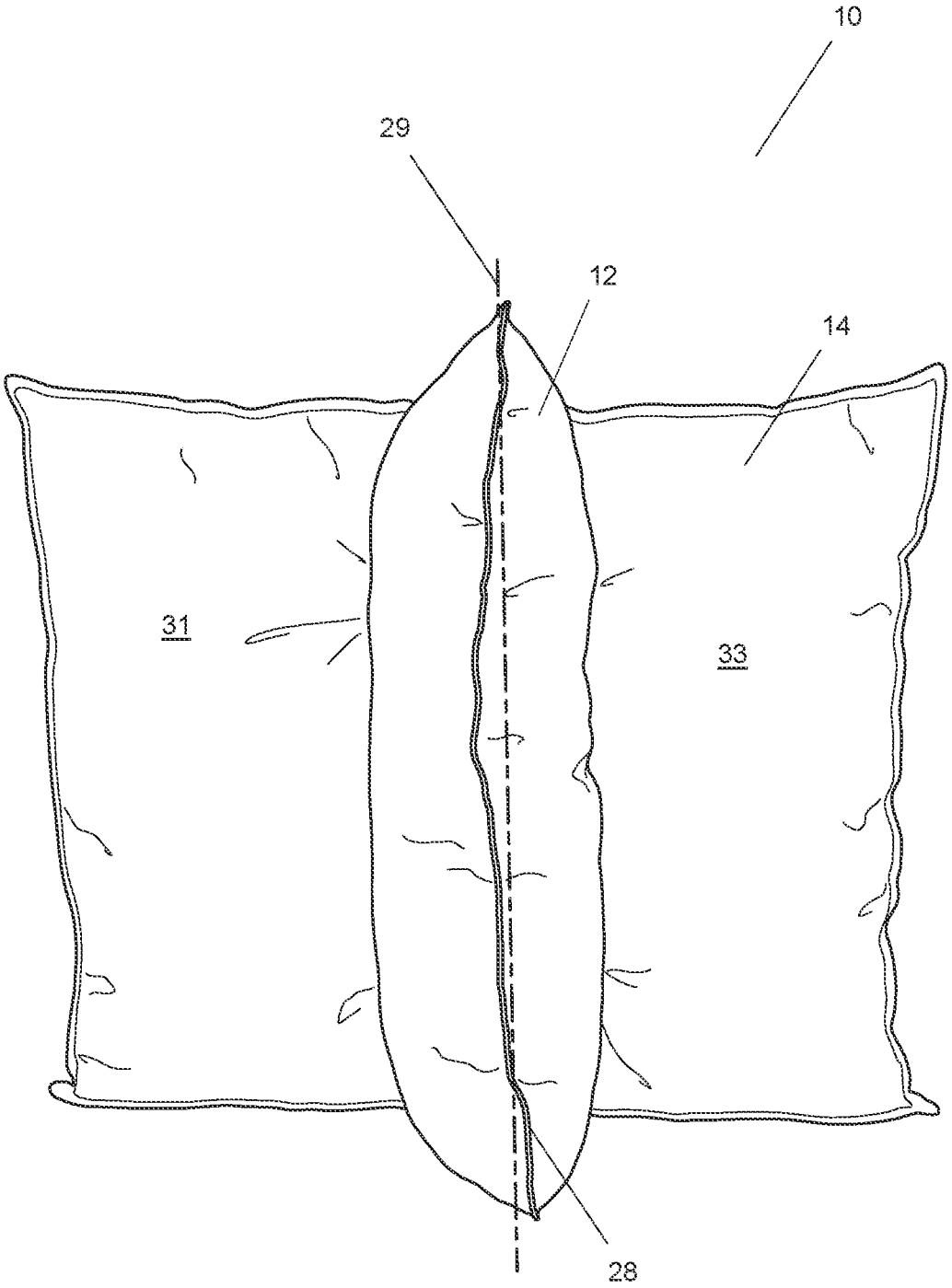
FIG. 4 is a front view of an exemplary interlocking pillow system according to an exemplary aspect of the present invention.
Figure 5:
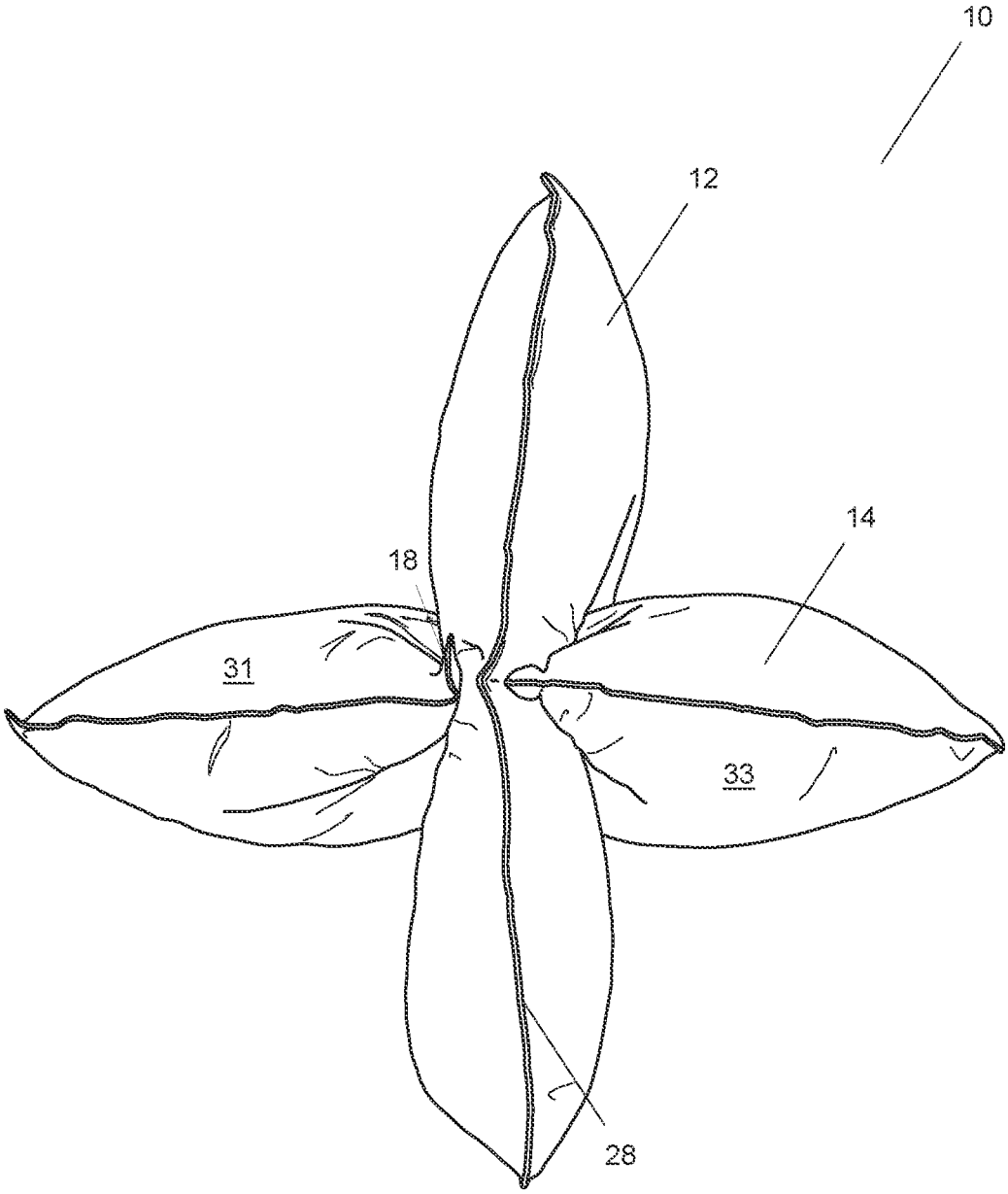
FIG. 5 is a top view of an exemplary interlocking pillow system according to an exemplary aspect of the present invention.

Referring specifically to FIG. 3, each of the first pillow form 12 and the second pillow form 14 may be encased within covers 22, 24. The first cover 22 has substantially the same shape as the first pillow form 12, including a corresponding passageway formed therein, and may include a loop handle 26 attached to the first cover 22. Likewise, the second cover 24 has substantially the same shape as the second pillow form 14, including corresponding notches formed therein. It is understood that the first cover 22 may be placed over the first pillow form 12, and the second cover 24 may be placed over the second pillow form 14 prior to the second pillow form 14 being inserted through the passageway 16 of the first pillow form 12. The first cover 22 and the second cover 24 may be made from any suitable material, for example designer and upholstery fabrics or quilted knits.

Figure 6:
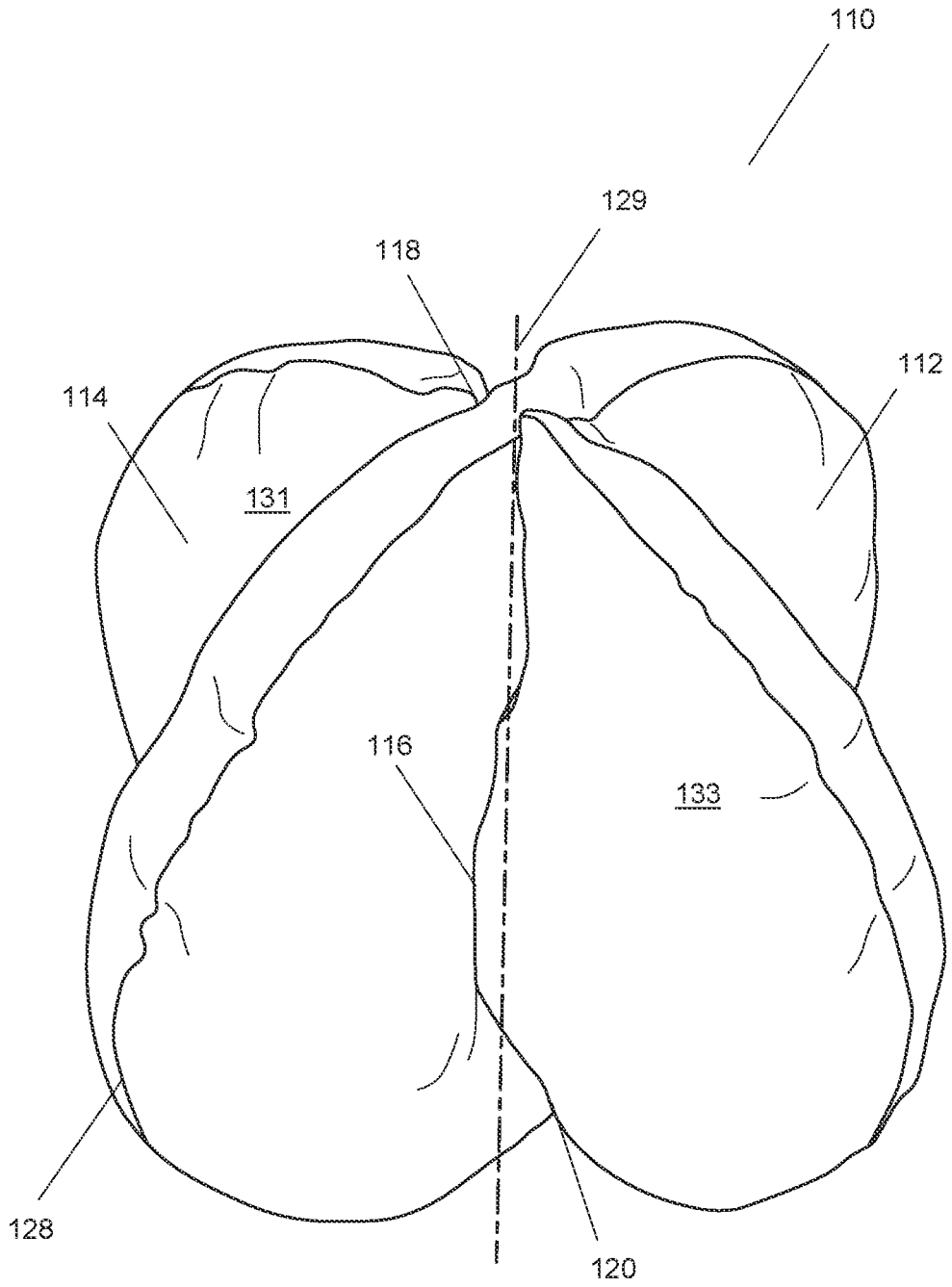
FIG. 6 is an isometric view of an exemplary interlocking pillow system according to an exemplary aspect of the present invention.
Figure 7:
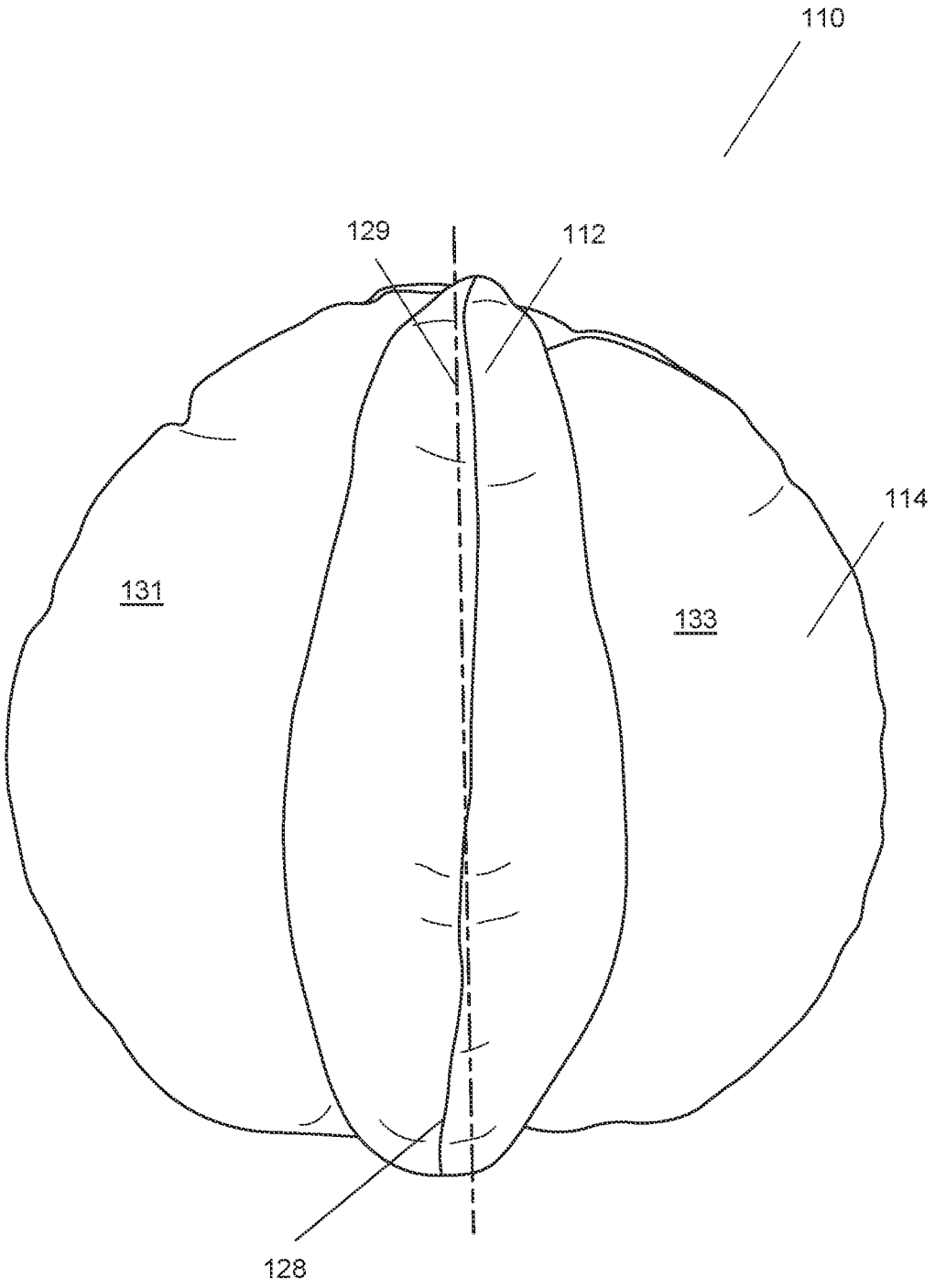
FIG. 7 is a front view of an exemplary interlocking pillow system according to an exemplary aspect of the present invention.
Figure 8:
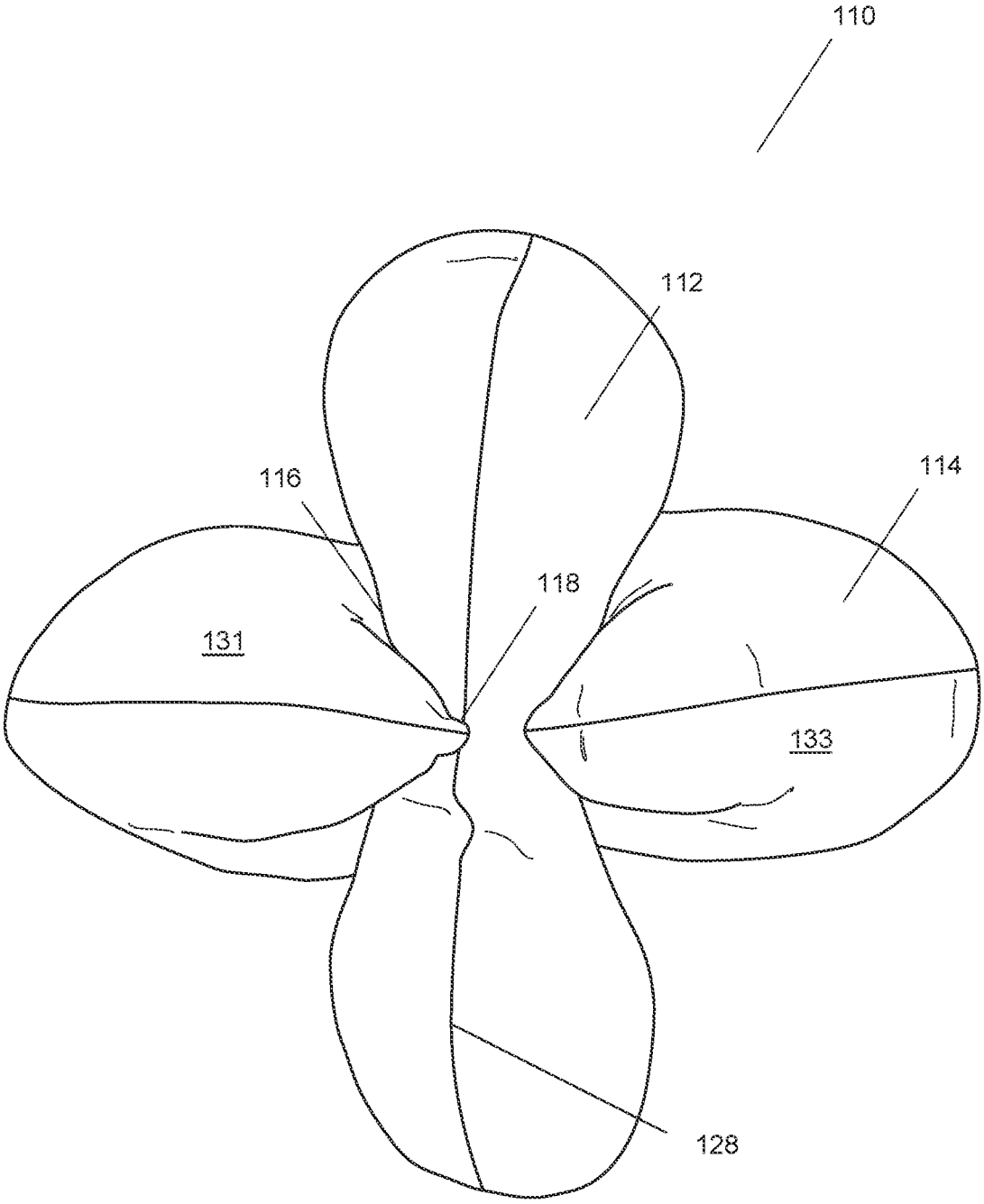
FIG. 8 is a top view of an exemplary interlocking pillow system according to an exemplary aspect of the present invention.

Referring now to FIGS. 6-8, therein illustrated is another exemplary embodiment of an interlocking pillow system, generally indicated by reference numeral 110, according to an exemplary aspect of the present invention. The interlocking pillow system 110 may include a first pillow form 112, and a second pillow form 114 configured for interlocking removable coupling with the first pillow form 112. The first pillow form 112 and the second pillow form 114 may be constructed of fabric coverings and filled with any suitable natural or synthenic pillow filling materials, such as poly fiber fill, shredded foam, down or any other material suitable to provide cushioning support to a user. For example, the first pillow form 112 and the second pillow form 114 may each be constructed by joining at least part of the perimeters of two pieces of fabric together through stitching, gluing and/or heat welding and then adding an appropriate amount of filling materials to the joined pieces of fabric and completely closing and/or sealing the pieces of fabric together so that the filling material cannot be easily removed from the constructed pillow form. It is understood that the construction of pillow forms is well known, and the present invention is not limited to any particular construction or fabrication of the pillow forms 112, 114.

Still referring to FIGS. 6-8, the first pillow form 112 may include a passageway 116, which may be formed in substantially the center area of the first pillow form 112. The first pillow form 112 may include a perimeter 128 extending around the first pillow form 112. As with the first pillow form 12 discussed above, the passageway 116 may be positioned a first distance from a side of the perimeter 128 and a second distance from another side of the perimeter 128. The passageway 116 may have a substantially rectangular, oval, or circular shape, and may be dimensioned so as to allow at least a portion of the second pillow form 114 to pass there through. It is understood that the present invention is not limited to any shape, size or configuration of the passageway 116, and any suitable opening formed in the first pillow form 112, for example a slit, is contemplated by the present invention.

Referring again to FIGS. 6-8, the second pillow form 114 may include a first notch 118 formed in one side of the second pillow form 114, and a second notch 120 formed in an opposing side of the second pillow form 114 as the first notch 118. The first notch 118 and the second notch 120 may be positioned on an axis 129 of the second pillow form 114. The first notch 118 and the second notch 120 may be formed as slits in the second pillow form 114, or as cutouts creating gaps in the periphery of the second pillow form 114. The first notch 118 and the second notch 120 may be positioned on the axis 129 of the second pillow form 114 such that the axis 129 forms a boundary between a first portion 131 of the second pillow form 114 and a second portion 133 of the second pillow form 114. It is understood the boundary formed by the axis 129 is not necessarily a physical boundary, but may rather simply be a demarcation between the first portion 131 and the second portion 133 of the second pillow form 114. The axis 129 may be positioned at substantially the mid-points of the sides of the second pillow form 114, such that when the second pillow form 114 is passed through the passageway 116 of the first pillow form 112, and the first notch 118 and the second notch 120 are engaged with the first pillow form 112, the sizes of the first portion 131 and the second portion 133 of the second pillow form 114 positioned on either side of the first pillow form 112 are substantially equal, as shown for example in FIGS. 7 and 8. In this interlocking relationship of the first pillow form 112 and the second pillow form 114 the interlocking pillow system 110 is composed, and at least a section of the passageway 116 of the first pillow form 112 is positioned along the axis 129 of the second pillow form 114. Furthermore, in the interlocking relationship at least part of the first portion 131, at least part of the second portion 133 or at least parts of each of the first portion 131 and second portion 133 are positioned within the passageway 116. The interlocked pillow system 110 is configured to allow the user to lean back and be supported from either side. The portion of the interlocked pillow system 110 where the first pillow form 112 and the second pillow form 114 intersect forms an indentation that allows the user's spine to be supported without any hard or harsh materials directly on the spinal column. Furthermore, the interlocking pillow system 110 provides an interlocking arrangement of the first pillow form 112 and the second pillow form 114 such that the weight of the body of the user compresses the interlocking pillow system 110 as much as needed and hugs the back of the user without being too bulky, while going back to its original shape when not in use. As with the interlocking pillow system 10 discussed above, the first pillow form 112 and the second pillow form 114 may have suitable coverings (not shown), including a loop handle (not shown) attached to one or both of the coverings.

Figure 9:
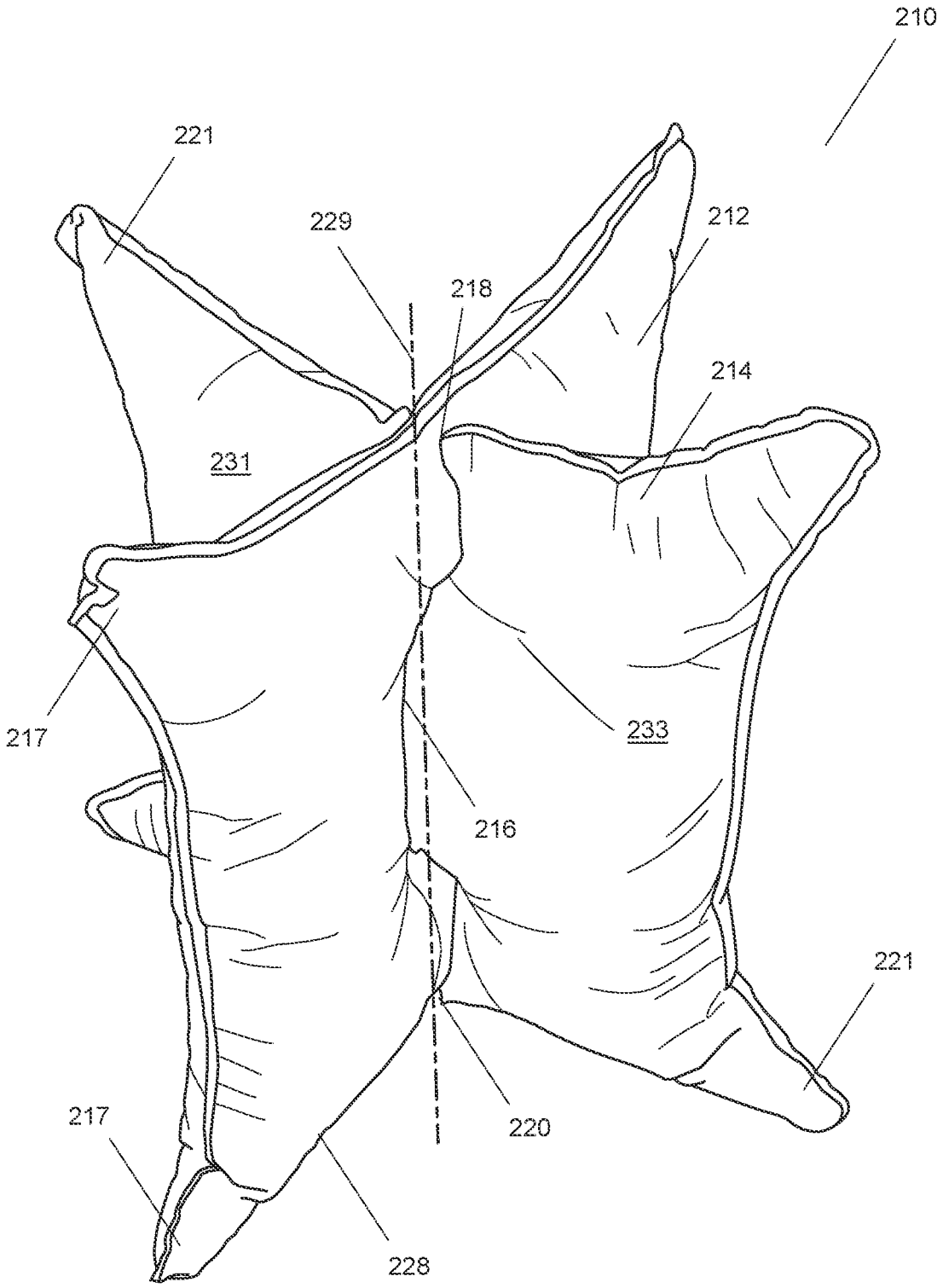
FIG. 9 is an isometric view of an exemplary interlocking pillow system according to an exemplary aspect of the present invention.
Figure 10:
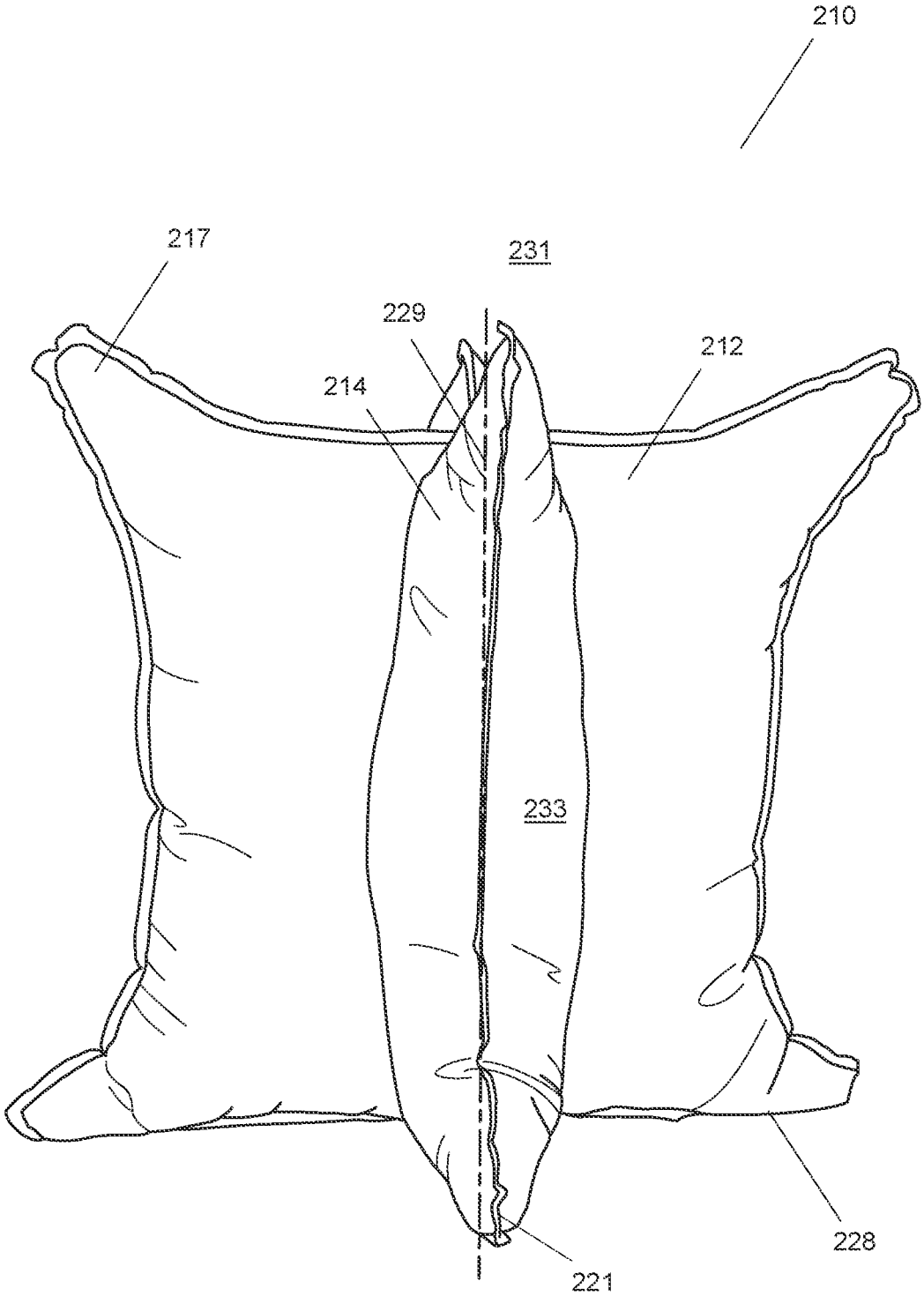
FIG. 10 is a front view of an exemplary interlocking pillow system according to an exemplary aspect of the present invention.
Figure 11:
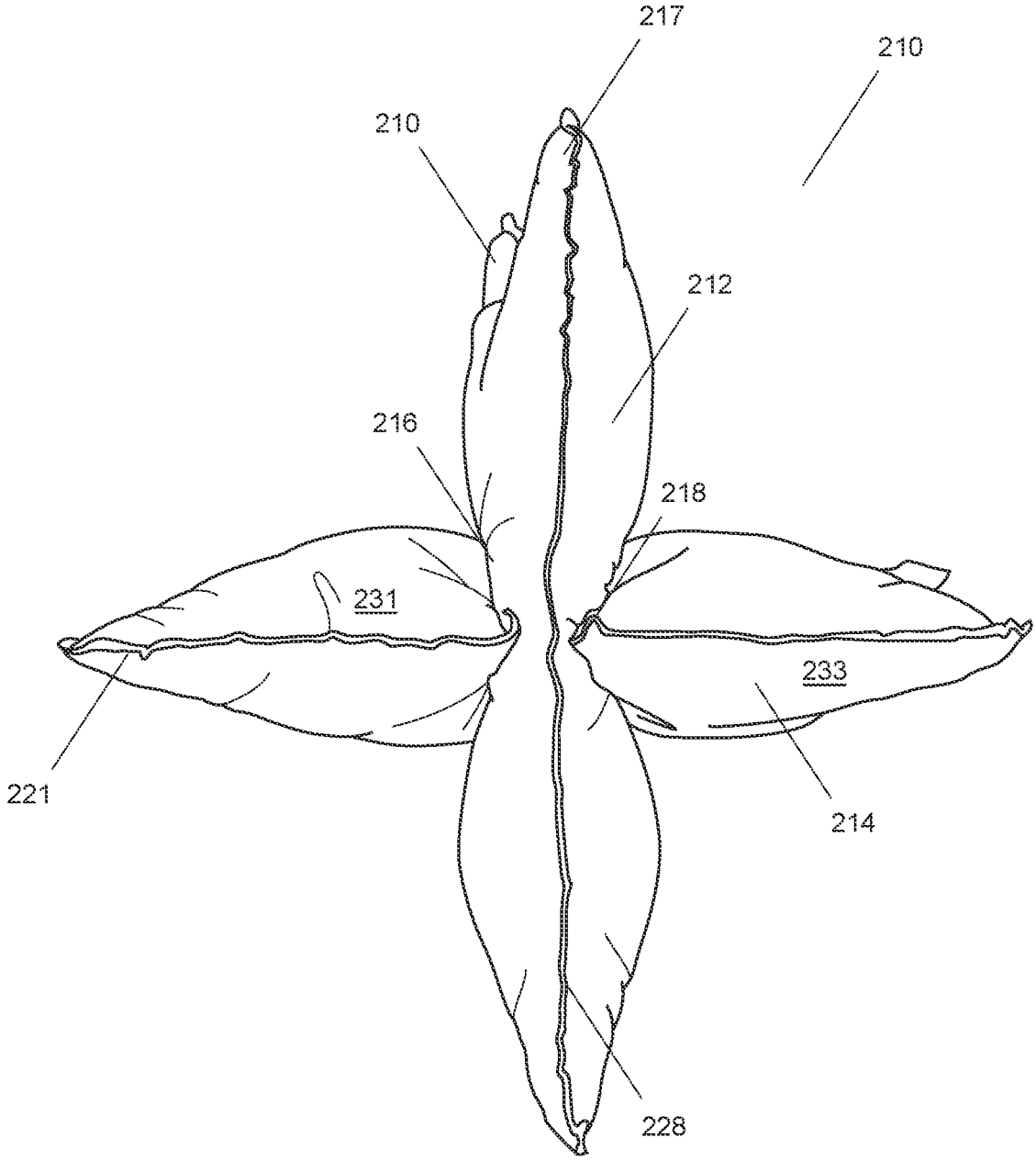
FIG. 11 is a top view of an exemplary interlocking pillow system according to an exemplary aspect of the present invention.
Figure 12:
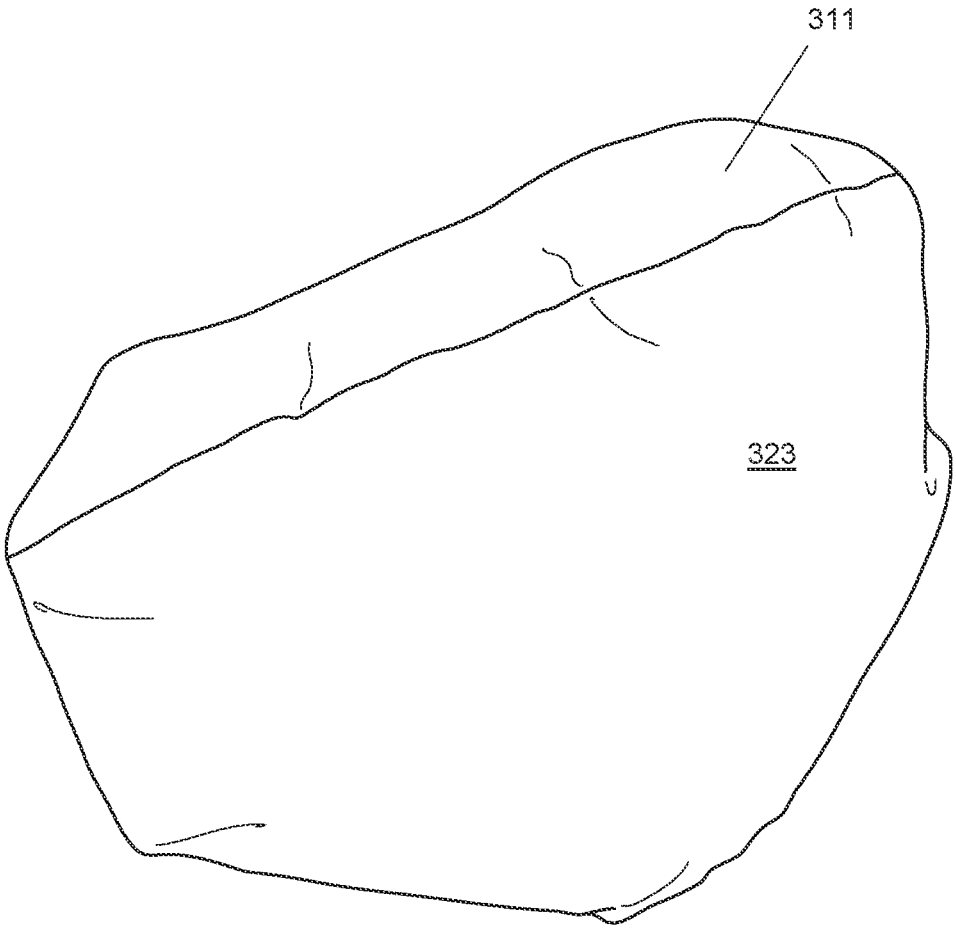
FIG. 12 is an isometric view of an exemplary supplementary pillow form according to an exemplary aspect of the present invention within a cover.
Figure 13:
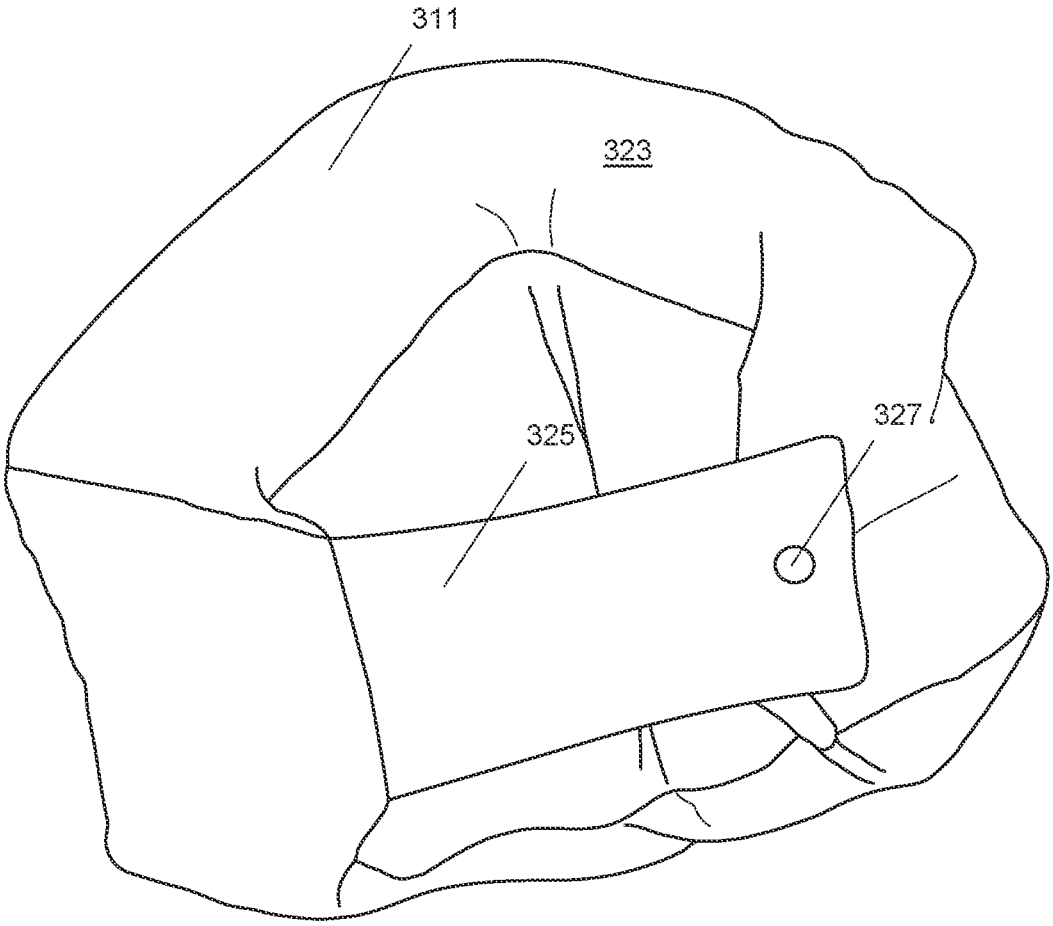
FIG. 13 is a rear view of an exemplary supplementary pillow form according to an exemplary aspect of the present invention within a cover.
Figure 14:
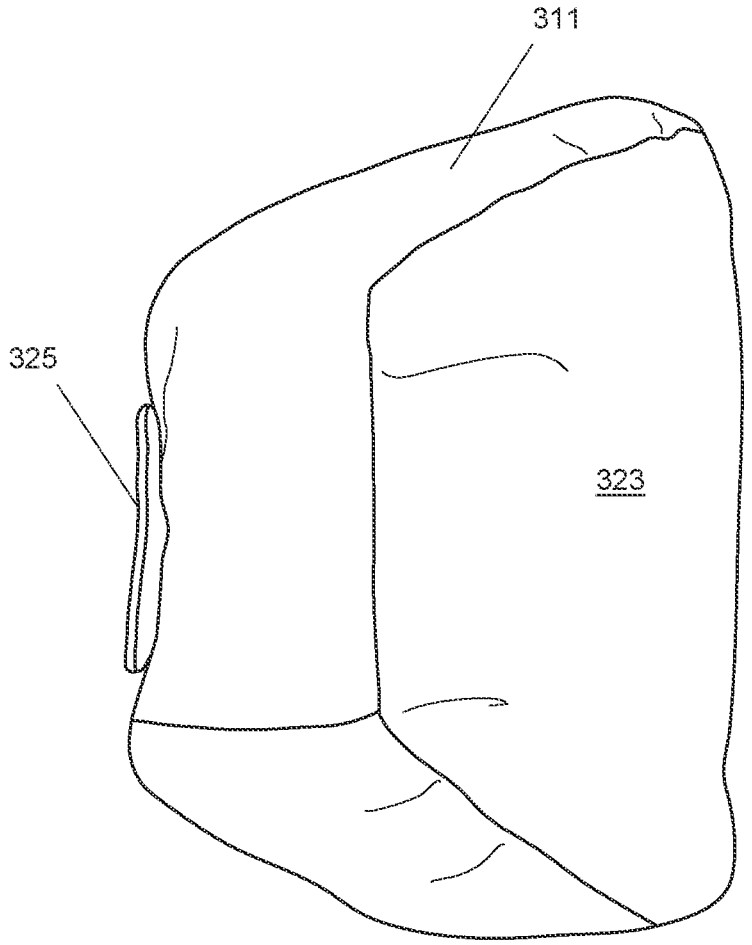
FIG. 14 is a side view of an exemplary supplementary pillow form according to an exemplary aspect of the present invention within a cover.
Figure 15:
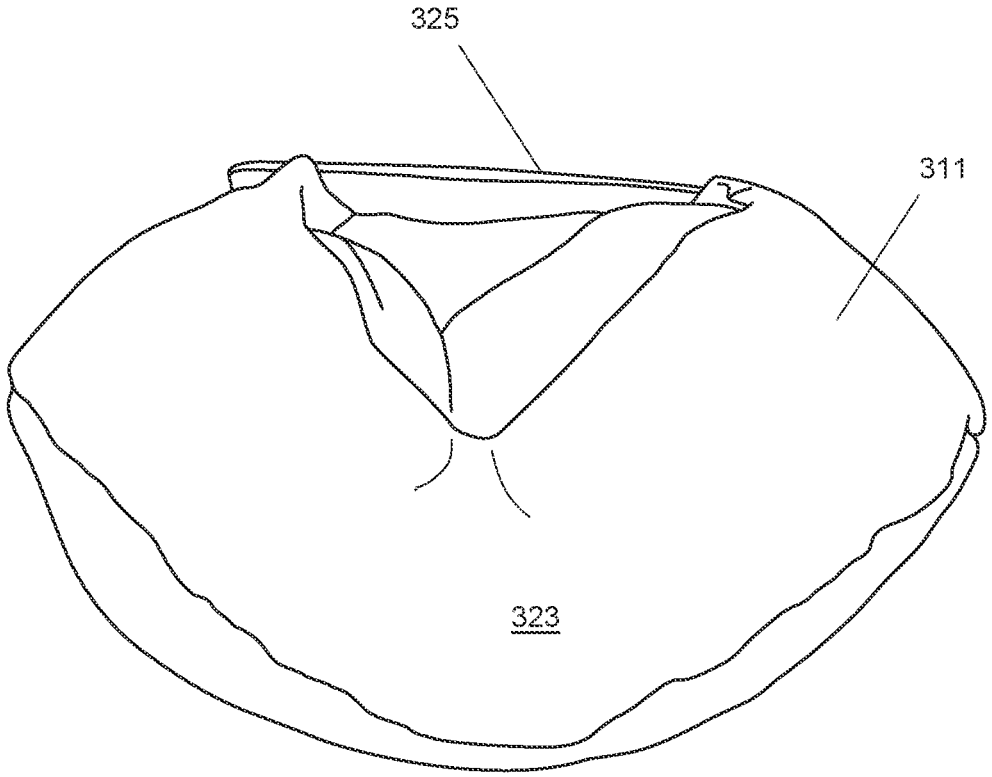
FIG. 15 is a top view of an exemplary supplementary pillow form according to an exemplary aspect of the present invention within a cover.

Referring now to FIGS. 9-11, therein illustrated is another exemplary embodiment of an interlocking pillow system, generally indicated by reference numeral 210, according to an exemplary aspect of the present invention. The interlocking pillow system 210 may include a first pillow form 212, and a second pillow form 214 configured for interlocking removable coupling with the first pillow form 212. The first pillow form 212 and the second pillow form 214 may be constructed of fabric coverings and filled with any suitable natural or synthetic pillow filling materials, such as poly fiber fill, shredded foam, down, or any other material suitable to provide cushioning support to a user. For example, the first pillow form 212 and the second pillow form 214 may each be constructed by joining at least part of the perimeters of two pieces of fabric together through stitching, gluing and/or heat welding and then adding an appropriate amount of filling materials to the joined pieces of fabric and completely closing and/or sealing the pieces of fabric together so that the filling material cannot be easily removed from the constructed pillow form. It is understood that the construction of pillow forms is well known, and the present invention is not limited to any particular construction or fabrication of the pillow forms 212, 214.

Still referring to FIGS. 9-11, the first pillow form 212 may include a passageway 216, which may be formed in substantially the center area of the first pillow form 212. The first pillow form 212 may include a perimeter 228 extending around the first pillow form 212. The passageway 216 may be positioned a first distance from a side of the perimeter 228 and a second distance from another side of the perimeter 228, these distances may be substantially equal, such that the passageway 216 may be positioned substantially in the center of the first pillow form 212. The passageway 216 may have a substantially rectangular, oval, or circular shape, and may be dimensioned so as to allow at least a portion of the second pillow form 214 to pass there through. It is understood that the present invention is not limited to any shape, size or configuration of the passageway 216, and any suitable opening formed in the first pillow form 212, for example a slit, is contemplated by the present invention Referring again to FIGS. 9-11, one or more of the corners of the first pillow form 212 may be configured to be pointed corners 217. The pointed corners 217 of the first pillow form 212 provide for better fill of a pillow case (not shown) placed over the first pillow form 212. The second pillow form 214 may include a first notch 218 formed in one side of the second pillow form 214, and a second notch 220 formed in an opposing side of the second pillow form 214 as the first notch 218. The first notch 218 and the second notch 220 may be formed as slits in the second pillow form 214, or as cutouts of the periphery of the second pillow form 214. One or more of the corners of the second pillow form 214 may be configured to be pointed corners 221. The pointed corners 221 of the second pillow form 214 provide for better fill of a pillow case (not shown) placed over the second pillow form 214. The first notch 218 and the second notch 220 may be positioned on the axis 229 of the second pillow form 214 such that the axis 229 forms a boundary between a first portion 231 of the second pillow form 214 and a second portion 233 of the second pillow form 214. It is understood the boundary formed by the axis 229 is not necessarily a physical boundary, but may rather simply be a demarcation between the first portion 231 and the second portion 233 of the second pillow form 214. The axis 229 may be positioned at substantially the mid-points of the sides of the second pillow form 214, such that when the second pillow form 214 is passed through the passageway 216 of the first pillow form 212, and the first notch 218 and the second notch 220 are engaged with the first pillow form 212, substantially equal portions of the second pillow form 214 are positioned on either side of the first pillow form 212, as shown for example in FIGS. 10 and 11. In this interlocking relationship of the first pillow form 212 and the second pillow form 214 the interlocking pillow system 210 is composed, and at least a section of the passageway 216 of the first pillow form 212 is positioned along the axis 229 of the second pillow form 214. Furthermore, in the interlocking relationship at least part of the first portion 231, at least part of the second portion 233 or at least parts of each of the first portion 231 and second portion 233 are positioned within the passageway 216. The interlocked pillow system 210 is configured to allow the user to lean back and be supported from either side. The portion of the interlocked pillow system 210 where the first pillow form 212 and the second pillow form 214 intersect at or about the axis 229 of the second pillow form 214 forms an indentation that allows the user's spine to be supported without any hard or harsh materials directly on the spinal column. Furthermore, the interlocking pillow system 210 provides an interlocking arrangement of the first pillow form 212 and the second pillow form 214 such that the weight of the body of the user compresses the interlocking pillow system 210 as much as needed and hugs the back of the user without being too bulky, while going back to its original shape when not in use. As with the interlocking pillow system 10 discussed above, the first pillow form 212 and the second pillow form 214 may have suitable coverings (not shown), including a loop handle (not shown) attached to one or both of the coverings.

Figure 18:
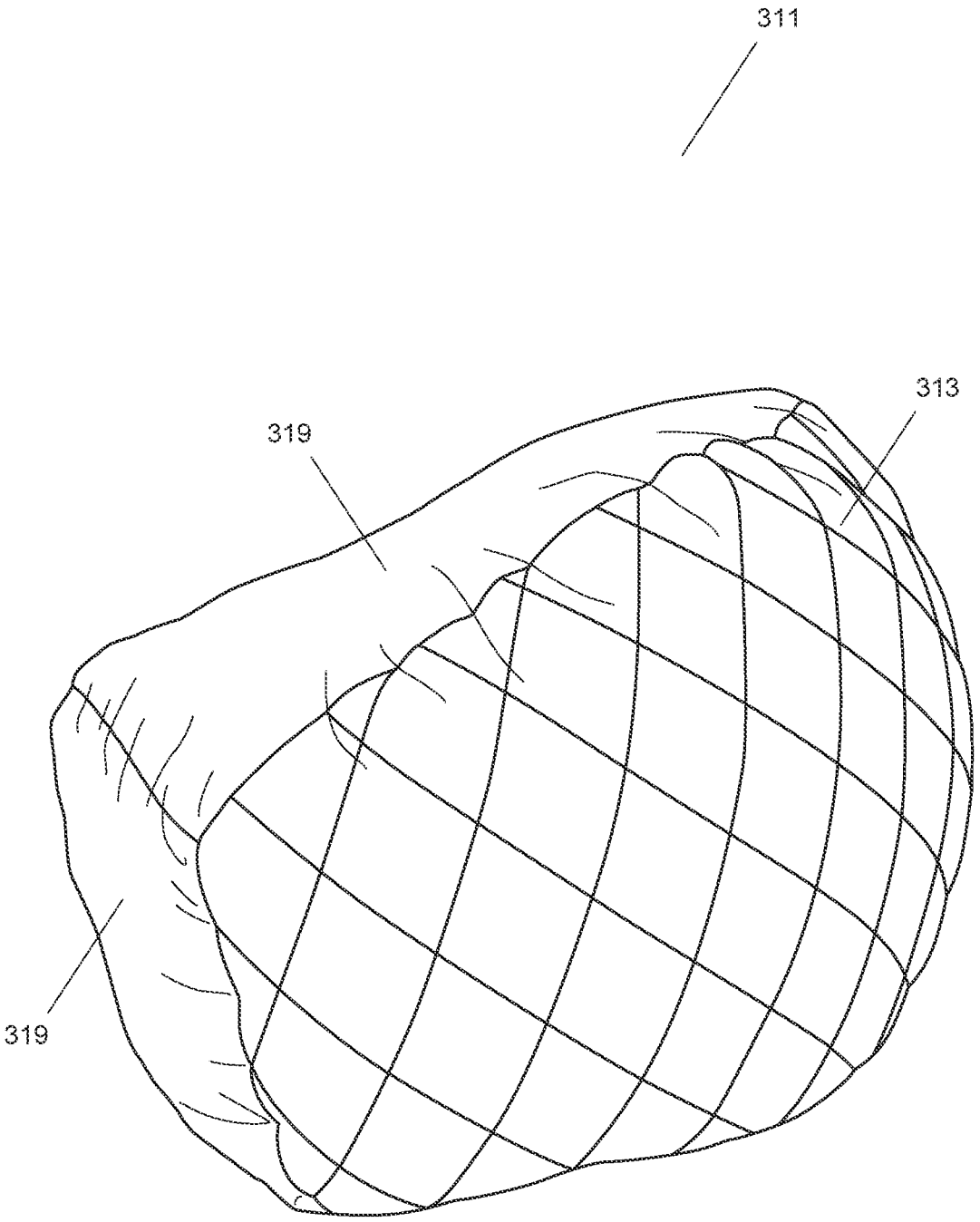
FIG. 18 is an isometric view of an exemplary supplementary pillow form according to an exemplary aspect of the present invention.
Figure 19:
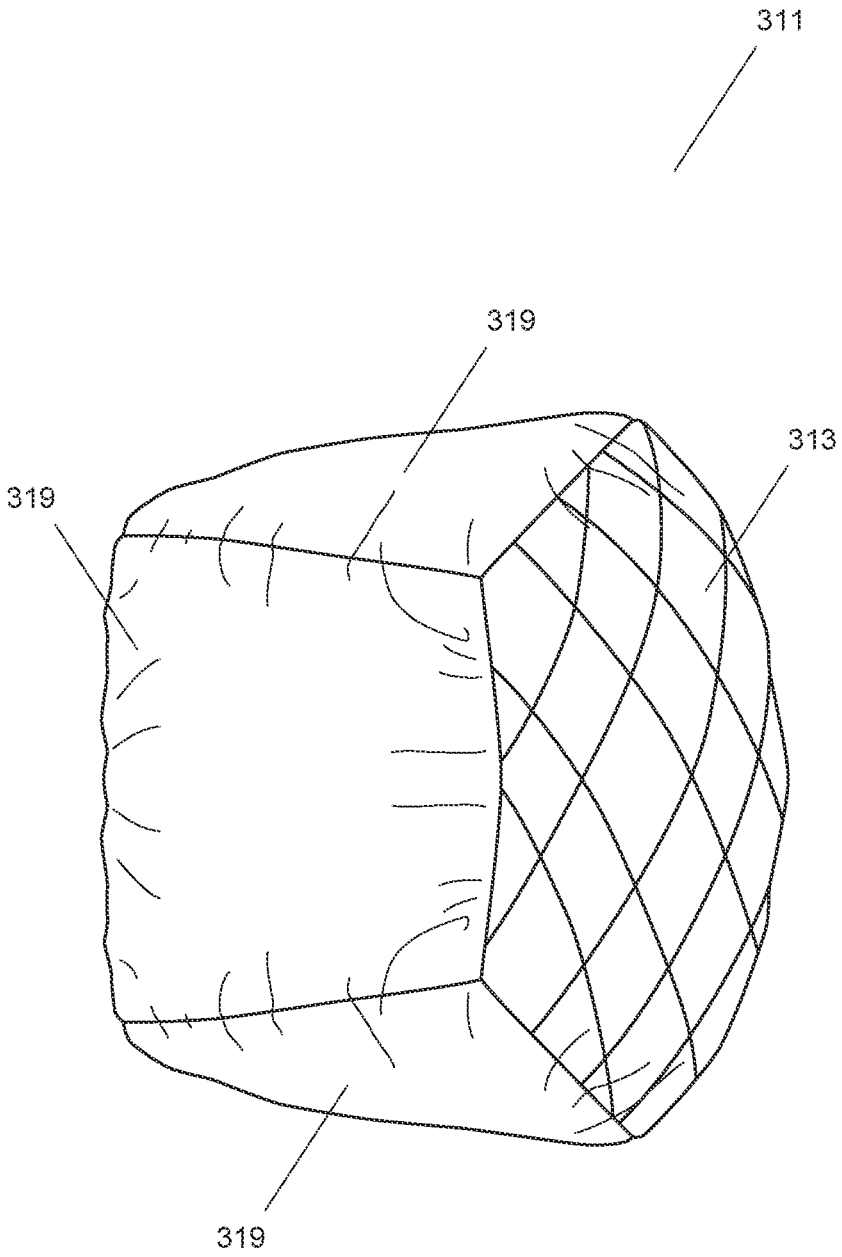
FIG. 19 is a side view of an exemplary supplementary pillow form according to an exemplary aspect of the present invention.
Figure 20:
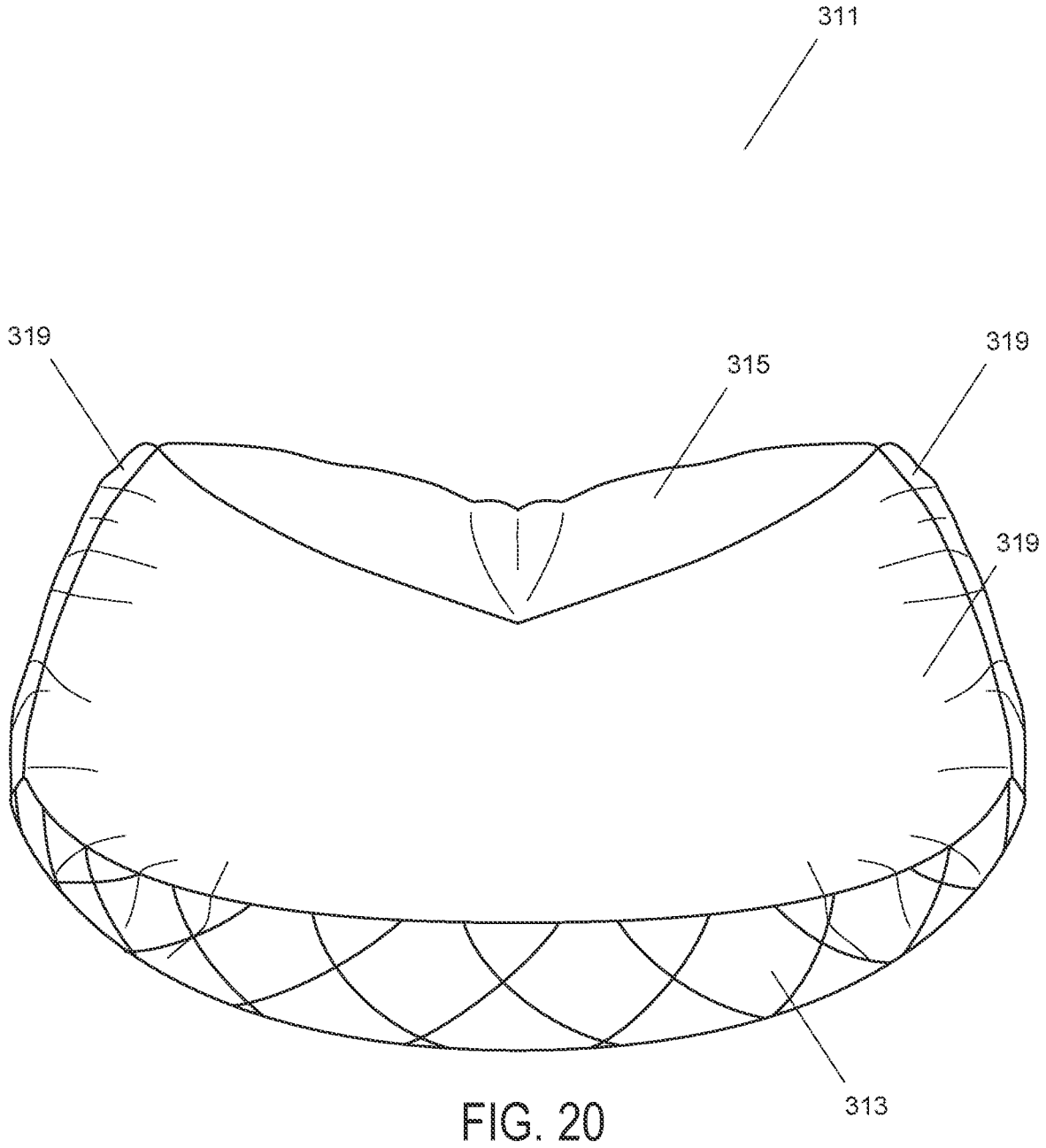
FIG. 20 is a top view of an exemplary supplementary pillow form according to an exemplary aspect of the present invention.

Referring now to FIGS. 18-20, therein illustrated is another exemplary embodiment of a supplementary pillow form, generally indicated by reference numeral 311, according to an exemplary aspect of the present invention. The supplementary pillow form 311 may be configured for use as a back and/or neck pillow. The supplementary pillow form 311 may have a substantially arched shape comprised of a quilted top 313 and a concave bottom 315 connected together by angled sides 319. The supplementary pillow form 313 may have an arch design with a conoid or funnel-like shape where the quilted top 313 is larger than the concave bottom 315. As a result, the arch or curve of the supplementary pillow form 313 provides for compression from the weight of the user's head for comfort, and resiliency to recover to its original shape. The quilted top 313 of the supplementary pillow form 311 may be constructed of a more durable fabric than the concave bottom 315 and/or angled sides 319. However, it is understood the present invention is not limited to any particular material and/or fabric selection for the quilted top 313, concave bottom 315 and/or angled sides 319. The supplementary pillow form 311 may be filed with a poly fill fiber, shredded foam or any other suitable material that provides comfort for a user.

Figure 16:
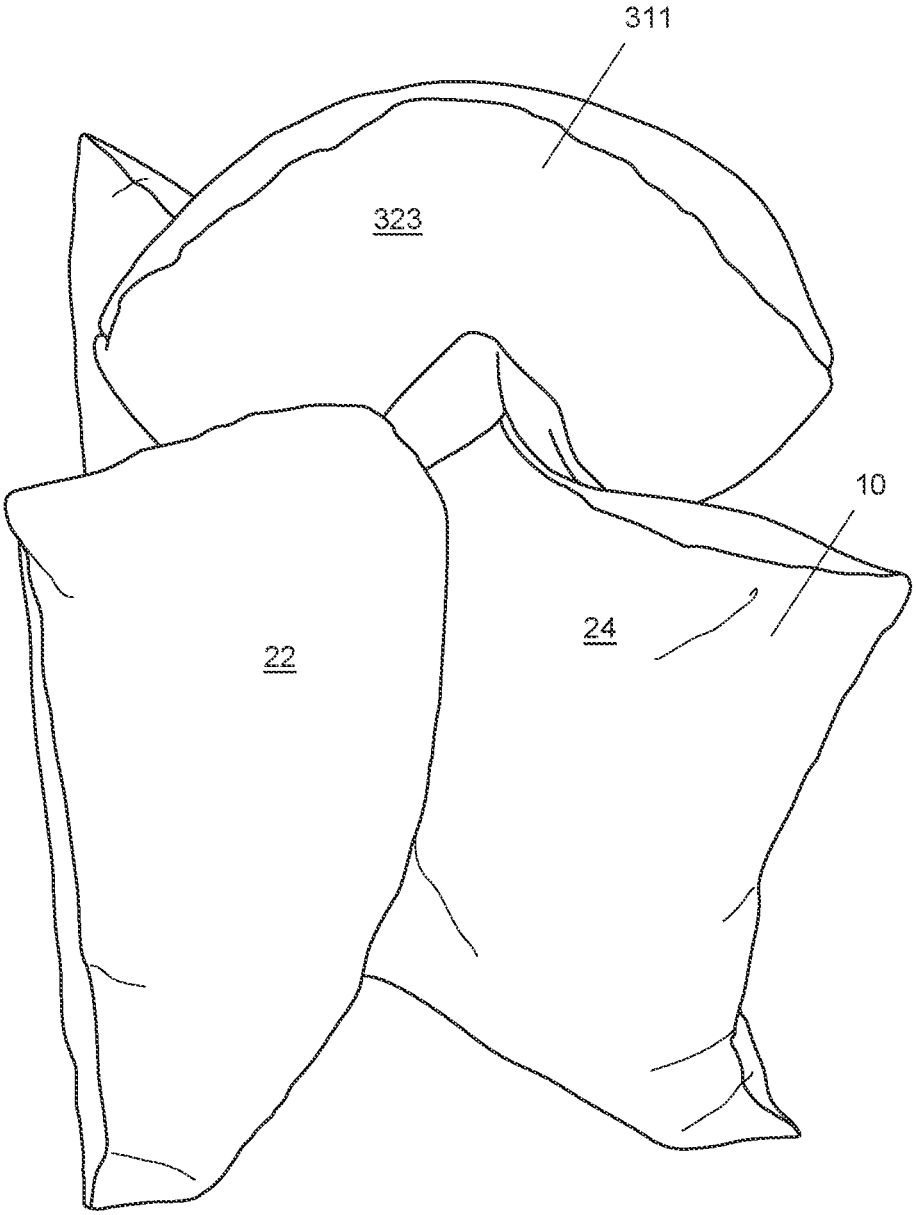
FIG. 16 is an isometric view of an exemplary supplementary pillow form affixed to an exemplary interlocking pillow system according to an exemplary aspect of the present invention.

Referring now to FIGS. 12-15, the supplementary pillow form 311 may be encased by a supplementary cover 323. The supplementary cover 323 may include a strap 325, and an attachment mechanism 327. The attachment mechanism 327 may be a snap, hook and pile fastener, button, hook and loop or any other suitable fastener that allows one end of the strap 325 to be removably affixed to the supplementary cover 323. The other end of the strap 325 may be secured to the supplementary cover 323. As shown in FIG. 16, the supplementary pillow form 311 may be configured to be removably affixed to the interlocking pillow system 10 (or any other exemplary interlocking pillow systems 110, 210) by attaching the strap 325 to the loop handle 26. In this configuration, the supplementary pillow form 311 may be configured to act as a headrest for use in chairs and couches where the user will be lounging or laying back to relax and sleep, read and/or watch television. The supplementary cover 323 may also include a zipper (not shown) and the strap 325 may be configured to secure the supplementary pillow form 311 to a seat, for example a headrest in a car, in order to hold the supplementary pillow form 311 at a certain place relative to the user for the user's comfort.

Figure 17:
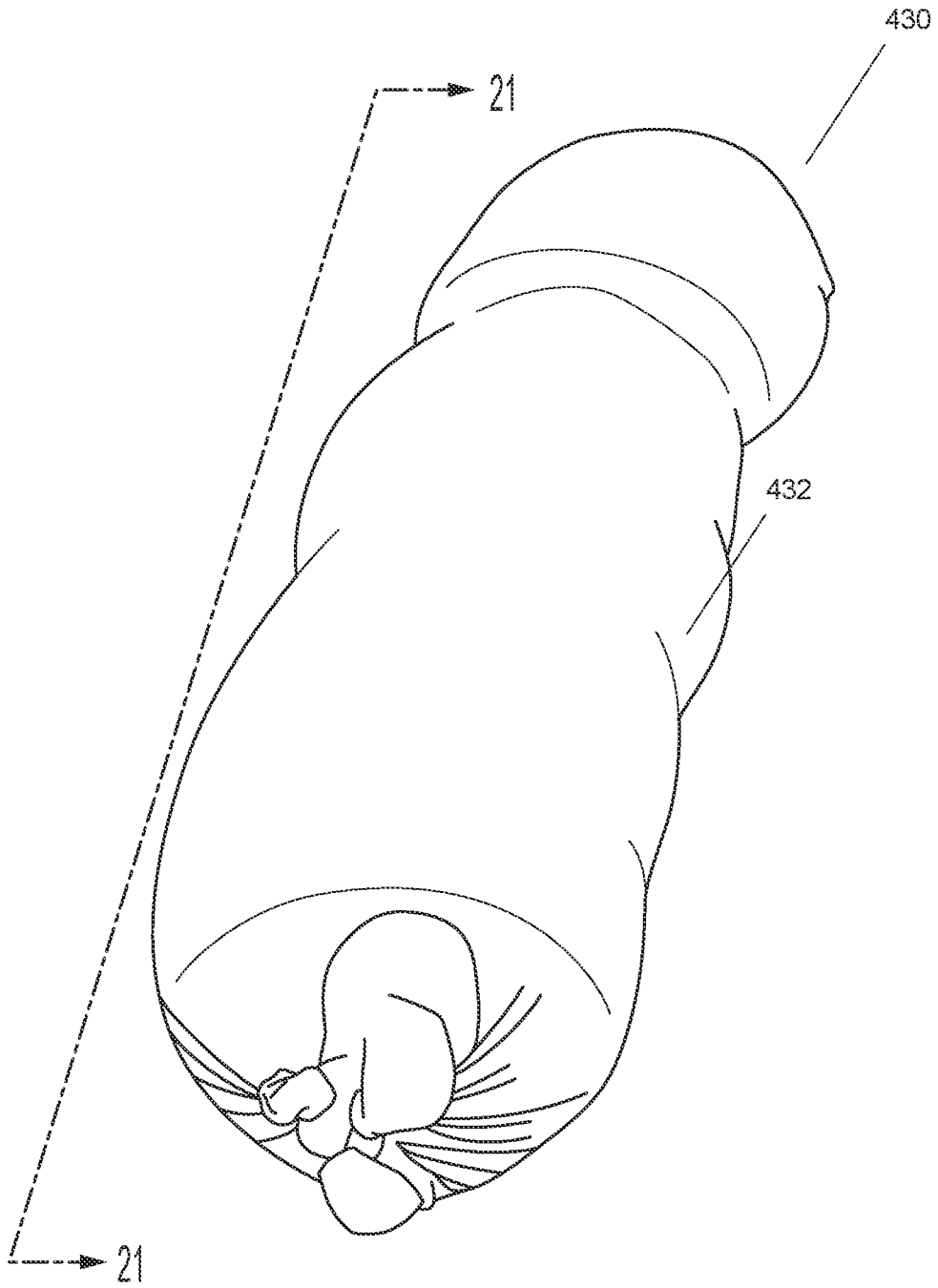
FIG. 17 is an isometric view of an exemplary body pillow according to an exemplary aspect of the present invention.
Figure 21:
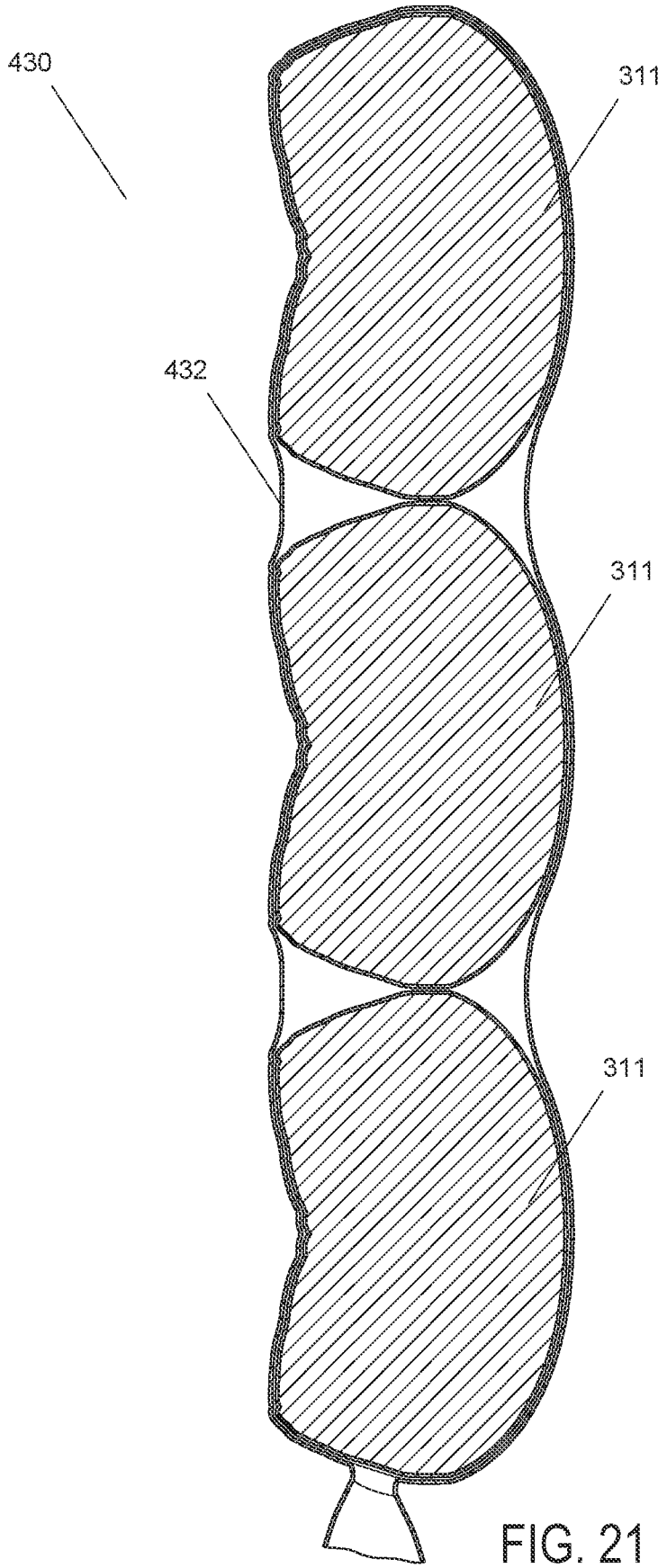
FIG. 21 is a cross-sectional view taken along line 21-21 from FIG. 17.

Referring now to FIGS. 17 and 21, therein illustrated is an exemplary body pillow 430 that is comprised of one or more supplementary pillow forms 311 placed within a casing 432. The supplementary pillow forms 311 may be arranged so that the body pillow 430 has flexibility and can be configured in a variety of orientations and positions. For example, the body pillow 430 may be formed into a U-shape and placed behind the back of a user for support while sitting in bed reading or while working at a computer. The body pillow 430 may also be configured to curve around the user in front of the user's body to allow for arm support on both sides while having the middle supplementary pillow form 311 within the body pillow 430 available for supporting a book, laptop or the like. The body pillow 430 may be configured for use in nursing a baby, as a result of the support given to the mother by resting her arms on both sides of the body pillow 430 and having the middle supplementary pillow form 311 support the weight of the baby. It is understood that while FIG. 21 shows the supplementary pillow forms 311 oriented in the same manner, any combination of orientations of the one or more supplementary pillow forms 311 within the casing 432 is contemplated by the present invention. The casing 432 may be a large rectangular knit pillow case. The body pillow 430 will have flexibility due to it being able to bend in at least two places due to the internal segments created by the separate supplementary pillow forms 311. In use, the user may be able to place supplementary pillow form 311 between the knees, have the middle supplementary pillow form 311 hugged into the belly area and the third supplementary pillow form 311 for the hands to hold and rest.

It will thus be seen that the objects set forth above, among those made apparent from the preceding description, are efficiently attained and, since certain changes may be made in the above article without departing from the scope of this invention, it is intended that all matter contained in this disclosure or shown in the accompanying drawings, shall be interpreted, as illustrative and not in a limiting sense. It is to be understood that all of the present figures, and the accompanying narrative discussions of corresponding embodiments, do not purport to be completely rigorous treatments of the invention under consideration. It is to be understood that the above-described arrangements are only illustrative of the application of the principles of the present invention. Numerous modifications and alternative arrangements may be devised by those skilled in the art without departing from the scope of the present invention.

What is claimed is:

1. A pillow system, comprising:

a first pillow form having a passageway formed therein; and a second pillow form having a first notch formed in a first side of the second pillow form, and a second notch formed in a second side of the second pillow form, wherein the first side is opposite from the second side;

wherein the first notch and the second notch of the second pillow form are positioned on an axis of the second pillow form;

wherein the first pillow form and the second pillow form are configured for an interlocking relationship in which at least a section of the passageway is positioned along the axis of the second pillow form;

wherein the first pillow form and the second pillow form each further comprise a fill material.

2. The pillow system according to claim 1, wherein the axis is a boundary between a first portion of the second pillow form and a second portion of the second pillow form; and wherein in the interlocking relationship of the first pillow form and the second pillow form, the first portion of the second pillow form and the second portion of the second pillow form are positioned on opposite sides of the passageway of the first pillow form.

3. The pillow system according to claim 1, wherein the first pillow form comprises a perimeter, and a first side of the passageway is positioned at a first distance from the perimeter and a second side of the passageway is positioned at a second distance from the perimeter.

4. The pillow system according to claim 2, wherein at least part of the first portion, the second portion or both are positioned within the passageway in the interlocking relationship of the first pillow form and the second pillow form.

5. The pillow system according to claim 2, wherein the first portion of the second pillow form positioned on one side of the passageway in the interlocking relationship is substantially equal in size to the second portion of the second pillow form positioned on an opposite side of the passageway in the interlocking relationship.

6. The pillow system according to claim 3, wherein the first distance and the second distance are substantially equal.

7. The pillow system according to claim 1, wherein the first pillow form and the second pillow form are substantially rectangular in shape.

8. The pillow system according to claim 1, wherein the first pillow form and the second pillow form are substantially circular in shape.

9. The pillow system according to claim 1, further comprising a first pillow form case having a hole formed therein and configured to at least partially encase the first pillow form; and a second pillow form case having a pair of indents formed therein and configured to at least partially encase the second pillow form.

10. The pillow system according to claim 1, further comprising a supplementary pillow form having an arched surface, a concave surface positioned opposite the arched surface and a plurality of angled sides connecting the arched surface with the concave surface.

11. The pillow system according to claim 10, wherein the supplementary pillow form comprises a supplementary pillow cover configured to at least partially encase the supplementary pillow form and having a strap configured to removably affix the supplementary pillow form to at least one of the first pillow form or the second pillow form.

12. The pillow system according to claim 10, wherein the arched top of the supplementary pillow form is quilted.

13. The pillow system according to claim 10, wherein the plurality of angled sides comprises a first pair of angled sides positioned opposite each other and in a non-parallel orientation, and a second pair of angled sides positioned opposite each other and in a non-parallel orientation, wherein the first pair of angled sides are larger than the second pair of angled sides.

14. The pillow system according to claim 10, wherein the supplementary pillow form further comprises a fill material.

15. A pillow system, comprising:

at least two supplementary pillow forms; and a casing at least partially containing the supplementary pillow forms;

wherein each supplementary pillow form comprises an arched surface, a concave surface positioned opposite the arched surface and a plurality of angled sides connecting the arched surface with the concave surface;

wherein the plurality of angled sides of each supplementary pillow form includes a first pair of angled sides positioned opposite each other on the supplementary pillow form in a non-parallel and non-intersecting orientation on the supplementary pillow form, and a second pair of angled sides positioned opposite each other on the supplementary pillow form in a non-parallel and non-intersecting orientation on the supplementary pillow form, wherein the first pair of angled sides are larger than the second pair of angled sides.

16. The pillow system according to claim 15, wherein each supplementary pillow form further comprises a fill material.

17. The pillow system according to claim 15, further comprising an additional supplementary pillow form.

18. The pillow system according to claim 15, wherein each of the supplementary pillow forms are arranged in the casing such that one of the sides of the second pair of angled side of each supplementary pillow form are in contact with each other.

* * * * *